US006951376B2

(12) United States Patent
Ishikawa

(10) Patent No.: US 6,951,376 B2
(45) Date of Patent: Oct. 4, 2005

(54) INKJET RECORDING METHOD AND APPARATUS

(75) Inventor: Wataru Ishikawa, Hachioji (JP)

(73) Assignee: Konica Corporation (JP)

( * ) Notice: Subject to any disclaimer, the term of this patent is extended or adjusted under 35 U.S.C. 154(b) by 166 days.

(21) Appl. No.: 10/405,451

(22) Filed: Apr. 2, 2003

(65) Prior Publication Data

US 2003/0189609 A1 Oct. 9, 2003

(30) Foreign Application Priority Data

Apr. 9, 2002 (JP) ..... 2002-106295

(51) Int. Cl.[7] ..... B41J 2/01
(52) U.S. Cl. ..... 347/11; 347/102
(58) Field of Search ..... 347/10, 11, 15, 347/17, 69, 88, 95, 99, 100, 102

(56) References Cited

U.S. PATENT DOCUMENTS 4,879,568 A * 11/1989 Bartky et al. ..... 347/69
5,521,619 A * 5/1996 Suzuki et al. ..... 347/10
6,142,608 A * 11/2000 Matsuda ..... 347/47
6,336,720 B1 * 1/2002 Suzuki et al. ..... 347/88
6,338,545 B1 * 1/2002 Sekiya ..... 347/47

FOREIGN PATENT DOCUMENTS

| | | |
|---|---|---|
| EP | 0 071 345 | 2/1983 |
| JP | 56-093776 | 7/1981 |
| JP | 58-32674 | 2/1983 |
| JP | 05-186725 | 7/1993 |

* cited by examiner

*Primary Examiner*—Lamson Nguyen
*Assistant Examiner*—Blaise Mouttet
(74) *Attorney, Agent, or Firm*—Cantor Colburn LLP

(57) ABSTRACT

There is described inkjet recording method and apparatus capable of printing very fine images stably on every type of printing material. The apparatus includes an ink-heating section to heat ink; an ink-jetting head having an ink channel, a volume of which is expanded and shrunken by applying a first electronic pulse and by successively applying a second electronic pulse, to emit an ink particle from a nozzle of the ink channel onto a recording medium so as to form the image on the recording medium; and an ultraviolet light irradiating section to irradiate ultraviolet light onto the recording medium for fixing the image; wherein, at a time after the ink particle is emitted by applying a first driving pulse to the ink channel and before an ink meniscus, formed at the nozzle, grows to an original stable state, a next ink particle is emitted by applying a second driving pulse.

16 Claims, 11 Drawing Sheets

FIG. 2 ( a )
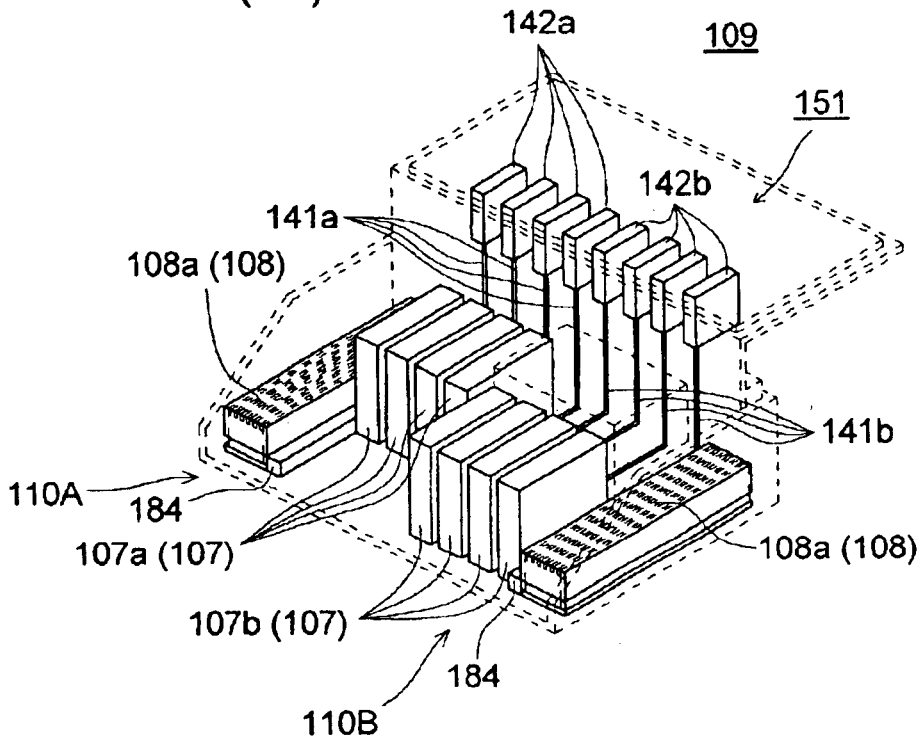
FIG. 2 ( b )
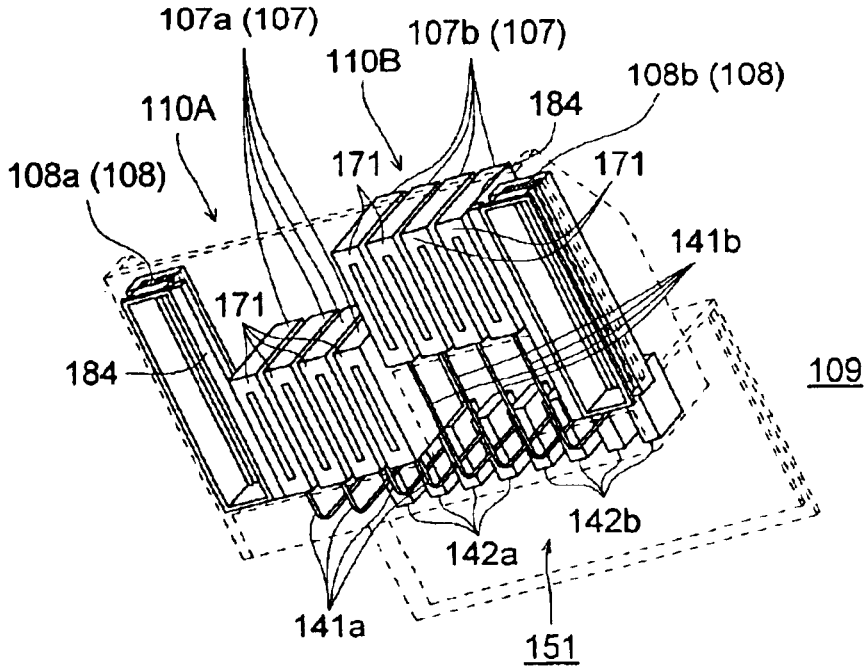

FIG. 8 ( a )
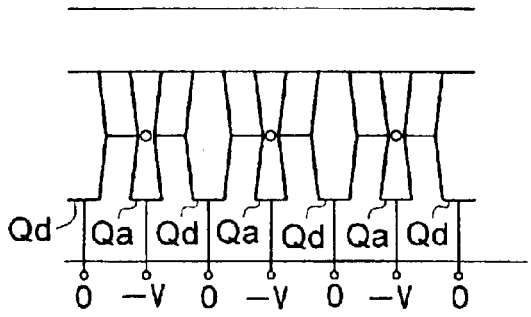
FIG. 8 ( b )
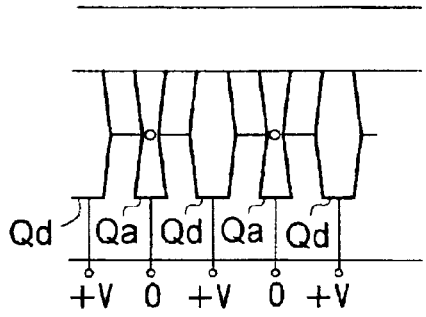
FIG. 9 ( a )
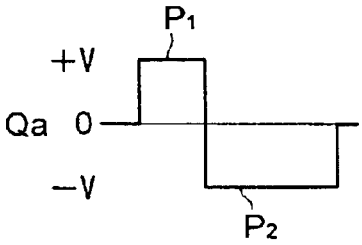
FIG. 9 ( c )
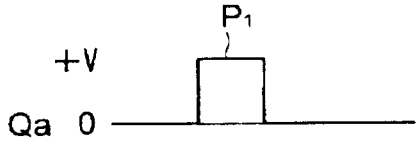
FIG. 9 ( b )
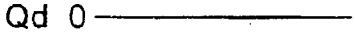
FIG. 9 ( d )
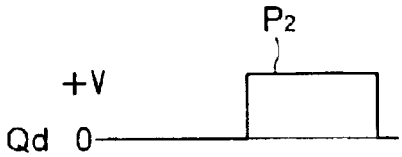

FIG. 14 ( a )
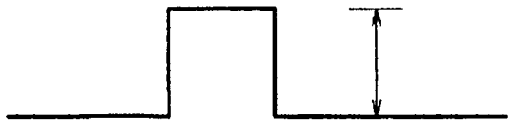
FIG. 14 ( b )
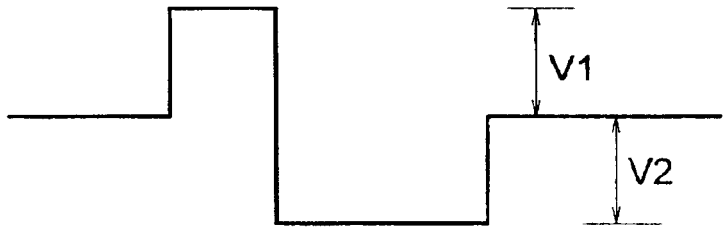

INKJET RECORDING METHOD AND APPARATUS

BACKGROUND OF THE INVENTION

The present invention relates to an inkjet recording method suitable for recording on every type of recording medium including a medium with no ink absorptivity.

Conventionally, water-soluble liquid ink composition has been widely used as the ink composition for inkjet recording. Besides, there has been proposed a hot-melt type inkjet recording method, using a hot-melt type ink composition made of wax or the like that remains solid at a room temperature, where the ink is liquefied by heating, emitted with the aid of some energy, and impacted on a recording medium, and then cooled immediately to harden and form a recording dot. This ink hardly causes stain during handling because it remains solid at a room temperature, and hardly causes clogging of nozzles because the ink evaporation when melted can be made minimal. In addition, the ink seldom causes blurredness because it hardens as soon as it is impacted on the medium, and so it produces an advantage that various kinds of recording media including Japanese paper, drawing paper, postcard, and plastic sheet without any pretreatment. An ink composition that provides excellent print quality irrespective of paper quality is disclosed in the U.S. Pat. Nos. 4,391,369 and 4,484,948.

An UV-setting resin type ink composition having excellent adhesion onto metallic surface is disclosed in the Japanese Application Patent Laid-Open Publication No. Sho 56-93776. Besides, there have been disclosed inkjet recording inks that are hardened by exposure to ultraviolet light: for example, the ink disclosed in the U.S. Pat. No. 4,228,438 where epoxy denaturated acrylic resin and urethane denaturated acrylic resin are used as binder and pigment in particle sizes of 5 $\mu$m or less is used as coloring material; the ink disclosed in the Japanese Application Patent Laid-Open Publication No. Sho 58-32674 (1983) where cation-polymerizing epoxy resin is used as binder; and the ink disclosed in the Japanese Application Patent Laid-Open Publication No. Hei 05-186725 (1993) where water-soluble or non-water-soluble dye is used, all of which are proposed to facilitate printing on ordinary paper and recycled paper.

As explained above, there has been desired an inkjet recording method that is capable of very fine printing, in picture quality, on various types of recording media such as plastic sheet without using special inkjet print paper.

When the above-mentioned water-soluble liquid ink is used for printing, printing on a recording medium that has no ink absorptivity is impossible and a large ink drying device is needed even if special print paper is used. Besides, it is applicable only limitedly because very fine printing is impossible due to resulting blurredness and so the resolution is limited.

While the hot-melt type ink using wax enables to print on a recording medium with no ink absorptivity and also to print at high speed, its abrasion resistance is very poor, and so the print result is lack of reliability and also less smooth.

On the other hand, since an inkjet recording method using organic pigment as coloring material has greater advantage, particularly in view of weather resistance, over an inkjet recording method using dye, wider applications are expected including not only office automation equipment, home-use printer, and office printer including facsimile but decoration on indoor and outdoor poster, large signboard, automobile, glass, elevator, wall and building, and also printing on cloth.

With a method where a recording liquid is hardened by exposure to light such as ultraviolet light, it is possible to print on a recording medium with no ink absorptivity. However, so far as an inkjet recording method that employs recording liquid which uses pigment but does not practically contain, in particular, water and organic solvent, and hardens the liquid by light such as ultraviolet light is concerned, there has never been reported of any example that is capable of very fine printing with controlled dot sizes as described in the present invention. For very fine printing, it is very important that sizes of the dots to be generated are controlled smaller. When special inkjet print paper is used, sizes of the dots to be generated can be controlled only by the amount of ink particles. In case of inkjet printing on a printing medium with no ink absorptivity, however, it is difficult to control the dot sizes only by the amount of ink particles. It is particularly difficult to control the dot sizes that comprise small particles.

SUMMARY OF THE INVENTION

To overcome the abovementioned drawbacks in conventional inkjet recording method and apparatus, it is an object of the present invention to provide inkjet recording method and apparatus, which make it possible to suppress clogging in ink head and blurredness of print and to achieve excellent stability (abrasion resistance, etc.) of print product, and which is capable of very fine printing with controlled dot sizes, and also capable of printing very fine images stably on every type of printing material.

Accordingly, to overcome the cited shortcomings, the abovementioned object of the present invention can be attained by inkjet recording method and apparatus described as follow.

A method for recording an image on a recording medium through an ink-jetting process, comprising the steps of: heating an ink, containing at least photo-polymerizing compound and coloring material, to a temperature in a range of 40–150° C.; expanding and shrinking a volume of an ink channel, which accommodates said ink and which is driving as electromechanical coverting actions, by applying a first electronic pulse for generating a negative presssure in said ink channel and by successively applying a second electronic pulse for generating a positive pressure in it, to emit an ink particle from a nozzle of said ink channel onto said recording medium so as to form said image thereon; and irradiating ultraviolet light onto said recording medium to fix said image thereon; wherein, at a time after said ink particle is emitted by applying a first driving pulse, being a combination of said first electronic pulse and said second electronic pulse, to said ink channel and before an ink meniscus, formed at said nozzle, grows to an original stable state, a next ink particle is emitted by applying a second driving pulse, being a next combination of said first electronic pulse and said second electronic pulse.

(2) The method of item 1, wherein a ratio between absolute voltage values of the first electronic pulse and the second electronic pulse, both included in the second driving pulse, is defined as the equations of $$R=V1/V2 \text{ and } 1.0 \leqq R \leqq 5.0$$

where R: the ratio, V1: an absolute voltage value of the first electronic pulse, V2: an absolute voltage value of the second electronic pulse.

(3) The method of item 2, wherein a plurality of ink channels, each of which is the ink channel, are provided for forming the image, and the electromechanical converting actions are achieved by deforming partitions of the plurality of ink channels in response to the first electronic pulse and the second electronic pulse, and wherein the partitions include piezoelectric elements being deformable in a shearing mode.

(4) The method of item 2, wherein a duration time of the first electronic pulse, included in the second driving pulse, is substantially equal to half an acoustical resonance period of the ink channel, while a duration time of the second electronic pulse, included in the second driving pulse, is substantially equal to twice the acoustical resonance period of the ink channel.

(5) The method of item 2, wherein an ink emitting amount per the ink particle is in a range of 2–20 pl (pico liter).

(6) The method of item 2, wherein a diameter of a dot, formed on the recording medium by emitting the ink particle thereon, is in a range of 50–200 $\mu$m.

(7) The method of item 2, wherein water and organic solvent are substantially excluded from components of the ink.

(8) The method of item 2, wherein a viscosity of the ink is in a range of 10–500 mPa·s at a temperature of 30° C.

(9) The method of item 2, wherein the recording medium has no ink absorptivity.

(10) The method of item 2, wherein the coloring material includes pigment, a mean dispersion particle-size of which is in a range of 10–200 nm, and an added amount of which is in a range of 0.5 to 30 mass-percent.

(11) An apparatus for recording an image on a recording medium through an ink-jetting process, comprising: an ink-heating section to heat an ink, containing at least photo-polymerzing compound and coloring material, to a temperature in a range of 40–150° C.; an ink-jetting head having an ink channel, which accommodates said ink and includes electromechanical converting elements, a volume of said ink channel being expanded and shrunken by applying a first electronic pulse to said electromechanical converting elements for generating a negative pressure in said ink channel and by successively applying a second electronic pulse to them for generating a positive pressure in it, to emit an ink particle from a nozzle of said ink channel onto said recording medium so as to form said image thereon; and an ultraviolet light irradiating section to irradiate ultraviolet light onto said recording medium for fixing said image thereon; wherein, at a time after said ink particle is emitted by applying a first driving pulse, being a combination of said first electronic pulse and said second electronic pulse, to said ink channel and before an ink meniscus, formed at said nozzle, grows to an original stable state, a next ink particle is emitted by applying a second driving pulse, being a next combination of said first electronic pulse and said second electronic pulse.

(12) The apparatus of item 11, wherein a ratio between absolute voltage values of the first electronic pulse and the second electronic pulse, both included in the second driving pulse, is defined as the equations of $$R=V1/V2 \text{ and } 1.0 \leq R \leq 5.0$$

where R: the ratio, V1: an absolute voltage value of the first electronic pulse, V2: an absolute voltage value of the second electronic pulse.

(13) The apparatus of item 12, wherein the ink-jetting head has a plurality of ink channels, each of which is the ink channel, and emits ink particles by deforming partitions of the plurality of ink channels in response to the first electronic pulse and the second electronic pulse, and wherein the partitions include piezoelectric elements serving as the electromechanical converting elements and being deformable in a shearing mode.

(14) The apparatus of item 12, wherein a duration time of the first electronic pulse, included in the second driving pulse, is substantially equal to half an acoustical resonance period of the ink channel, while a duration time of the second electronic pulse, included in the second driving pulse, is substantially equal to twice the acoustical resonance period of the ink channel.

(15) The apparatus of item 12, wherein an ink emitting amount per the ink particle is in a range of 2–20 pl (pico liter).

(16) The apparatus of item 12, wherein a diameter of a dot, formed on the recording medium by emitting the ink particle thereon, is in a range of 50–200 $\mu$m.

(17) The apparatus of item 12, wherein water and organic solvent are substantially excluded from components of the ink.

(18) The apparatus of item 12, wherein a viscosity of the ink is in a range of 10–500 mPa·s at a temperature of 30° C.

(19) The apparatus of item 12, wherein the recording medium has no ink absorptivity.

(20) The apparatus of item 12, wherein the coloring material includes pigment, a mean dispersion particle-size of which is in a range of 10–200 nm, and an added amount of which is in a range of 0.5 to 30 mass-percent.

Further, to overcome the abovementioned problems, other inkjet recording methods, embodied in the present invention, will be described as follow:

(21) An inkjet recording method, characterized in that, in the inkjet recording method in which ink containing, at least, photo-polymerizing compound and coloring material is heated to 40 to 150° C. by a heating means, an image is formed on a recording medium as an ink channel being expanded and shrunk by an electromechanical converting means and ink particle is emitted from a nozzle, and then ultraviolet light is irradiated on it, at a time after the ink particle is emitted with the aid of the first drive pulse, comprising the first pulse for generating negative pressure and the second pulse to follow for generating positive pressure in the ink channel, another ink particle is emitted with the aid of the second drive pulse, comprising the first pulse for generating negative pressure and the second pulse to follow for generating positive pressure in the ink channel, and before the ink meniscus of the nozzle returns to the original standby position before the previous ink particle emission, the ratio (V1/V2) of the absolute value V1 of the voltage of the first pulse over the absolute value V2 of the voltage of the second pulse in the second drive pulse is 1.0 to 5.0.

(22) The inkjet recording method, according to item 1 above, characterized in that multiple ink channels are provided and the electromechanical converting means consists of piezoelectric elements that deform the partition of the ink channels in a shear mode.

(23) The inkjet recording method, according to item 1 or 2 above, characterized in that the duration of the first pulse in the second drive pulse is practically equivalent to AL (half the acoustical resonance period) of the ink channel and the duration of the second pulse is practically equivalent to 2AL of the ink channel.

(24) The inkjet recording method, according to any one of items 1 to 3 above, characterized in that the ink emission per particle is 2 to 20 pl.

(25) The inkjet recording method, according to any one of items 1 to 4 above, characterized in that the size of the dot to be generated on a recording medium is 50 to 200 $\mu$m.

(26) The inkjet recording method, according to any one of items 1 to 5 above, characterized in that the ink does not practically contain water and organic solvent.

(27) The inkjet recording method, according to any one of items 1 to 6 above, characterized in that the viscosity of the ink at 30° C. is 10 to 500 mPa·s.

(28) The inkjet recording method according to any one of items 1 to 7 above, characterized in that the recording medium has no ink absorptivity.

(29) The inkjet recording method according to any one of items 1 to 8 above, wherein pigment is used as the coloring material and the mean dispersion size of the pigment is 10 to 200 nm and the amount added is 0.5 to 30 weight %.

BRIEF DESCRIPTION OF THE DRAWINGS

Other objects and advantages of the present invention will become apparent upon reading the following detailed description and upon reference to the drawings in which:

FIG. 2(*a*) and FIG. 2(*b*) show perspective views of the carriage installed on the inkjet printer shown in FIG. 1;

FIG. 8(*a*) and FIG. 8(*b*) show diagrams indicating motions of another ink particle emitting device;

FIG. 9(*a*), FIG. 9(*b*), FIG. 9(*c*) and FIG. 9(*d*) show diagrams indicating an example of the first pulse and second pulse;

FIG. 14(A) and FIG. 14(B) show diagrams indicating the waveform of the drive pulse for emitting the ink.

DETAILED DESCRIPTION OF THE PREFERRED EMBODIMENT

Figure 1:
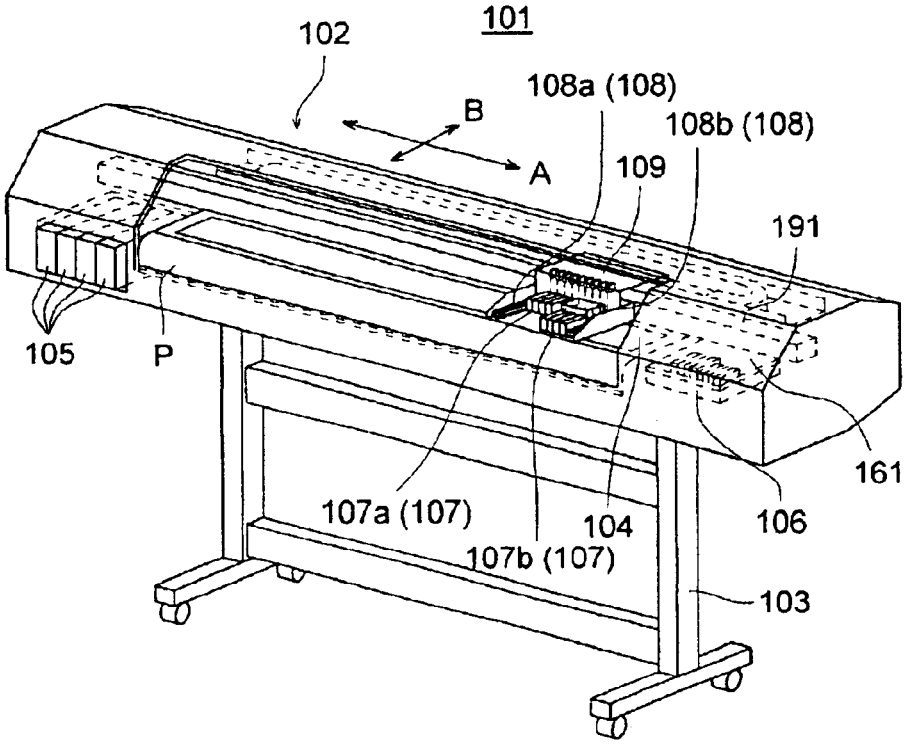
FIG. 1 shows a perspective view of the main components of an inkjet printer according to the preferred embodiment to which the present invention applies.

Referring to the drawings, a preferred embodiment of the present invention will be detailed in the following. The scope of the present invention, however, is not limited to the concrete examples shown in the drawings.

FIG. 1 is a perspective view of the main components of an inkjet printer according to the preferred embodiment to which the present invention applies.

As shown in FIG. 1, the inkjet printer 101 comprises a printer body 102 and a support leg 103 for supporting the printer body 102. On the printer body 102, a platen 104 that supports the lower surface of the recording medium P is installed approximately level.

On the left of the platen 104 shown in FIG. 1, there are provided four replaceable ink tanks 105 for storing UV ink, corresponding to four UV ink colors used on the inkjet printer 101.

On the right of the platen 104 shown in FIG. 1, there is provided a maintenance mechanism 106 that operates to clean the emission surface 171 (See FIG. 2(*a*) and FIG. 2(*b*)) of a recording head 107 and, during the standby time, cap the emission surface. A freely operating shutter 161 for shutting up ultraviolet light is provided above the maintenance mechanism 106 so that it is open at the time of maintenance when the above cleaning and capping are performed and shut for the rest of the time. The shutter 161, when shut, is so constructed that the illuminance of the ultraviolet light, at least, onto the maintenance mechanism 106 is less than 1% of the illuminance of the ultraviolet light onto the recording medium P at the time when an image is generated. Although the maintenance mechanism 106 in this embodiment is so constructed to perform cleaning and capping of the emission surface at the same position, it is also acceptable to so construct the printer as to perform cleaning and capping at two different positions. If the printer is so constructed as to perform cleaning and capping at two different positions, it is preferable to provide two different shutters corresponding to the two positions.

Above the platen 104, there is provided a carriage 191 that reciprocates along the main scanning direction A as guided by a carriage rail 191 extending along the main scanning direction A. A recording head 107 and an ultraviolet light irradiating portion 108 are installed on the carriage 109.

Figure 3:
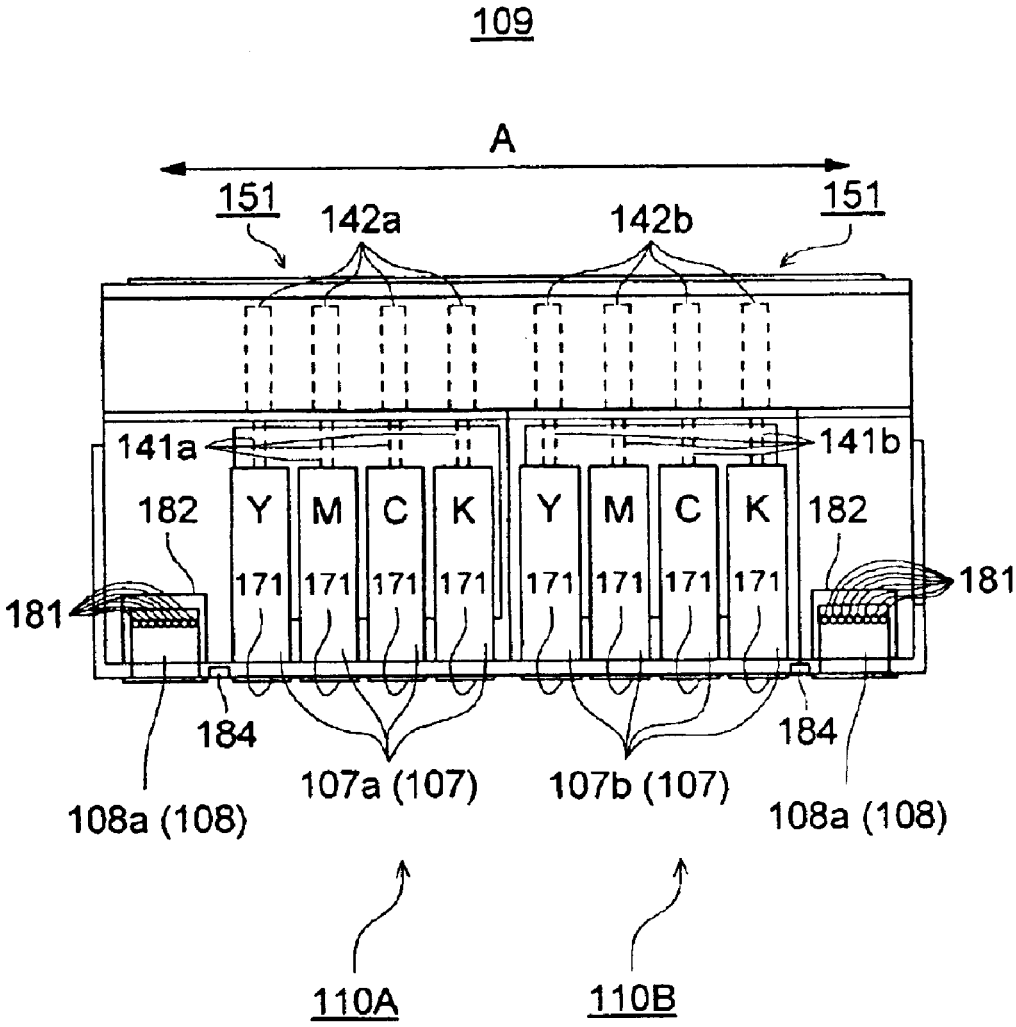
FIG. 3 shows a typical cross-sectional view of the carriage shown in FIG. 2, illustrating along the sub scanning direction.

Detailed description about the carriage 109 is given below, making reference to FIG. 2(*a*) and FIG. 3. FIG. 2(*a*) is a perspective view of the carriage 109, viewing from approximately the same direction in FIG. 1 and FIG. 2(*b*) is a diagonal view of the carriage 109, viewing upward from the right bottom in FIG. 1. FIG. 3 is a typical cross-sectional view along the sub scanning direction B perpendicular to the main scanning direction A.

On the left of the carriage 109 in FIG. 3, there is provided the first image recording portion 110A that generates an image as the carriage 109 moves to the right along the main scanning direction A. On the right of the carriage 109 in FIG. 3, there is provided the second image recording portion 110B that generates an image as the carriage 109 moves to the left along the main scanning direction A. Each of the first and second image recording portions 110A and 110B is equipped with multiple recording heads 107 (107*a*, 107*b*) for emitting UV ink, arranged in series along the main scanning direction A.

Four each recording heads 107*a* and 107*b*, corresponding to the four colors (Yellow (Y), Magenta (M), Cyan (C), and Black (K)) of UV ink used on the inkjet printer 101, are provided on the first and second image recording portions 110A and 110B, respectively.

Each recording head 107 is so installed that the upper surface of the recording medium P, carried on the platen 104, is opposed to the emission surface 171 of the recording head 107. Besides, each recording head 107 is equipped with multiple emission ports 173 of the nozzles 172 (See FIG. 4) on its emission surface, and the multiple emission ports 173 are arranged in a row (a row of nozzles) along the sub scanning direction B in line with the nozzles 172. Further, each recording head 107 has an emission mechanism (not shown) such as a piezoelectric element inside, and is designed to emit UV ink particle independently from each emission port 173 with the aid of the function of the emission mechanism.

The four colors can be arranged symmetrically (for example, in order of KCMYYMCK or YMCKKCMY) so that no color difference is caused in the two-directional printing and that the UV hardening characteristic does not deteriorate.

In the rear of the recording head 107*a* and 107*b* at the first and second image recording portions 110A and 110B, respectively, there are provided multiple ink channels 151, for each color, for supplying the UV ink stored in the ink tank 105 to the recording heads 107*a* and 107*b*. The ink channel 151 comprises an ink tube (not shown) extending from the ink tank 105 up to the carriage 109, intermediate tanks 142*a* and 142*b* for storing temporarily the UV ink supplied through the ink tube, and ink supply tubes 141*a* and 141*b* for supplying the UV ink from the intermediate tanks 142*a* and 142*b* to the recording heads 107. The UV ink stored in each intermediate tank 142*a* and 142*b* is supplied to each recording head through the above tubing.

Hereunder, the inkjet recording method and ink particle emitting device according to the present invention that can be applied to the above-mentioned inkjet printer are described in detail.

Figure 4:
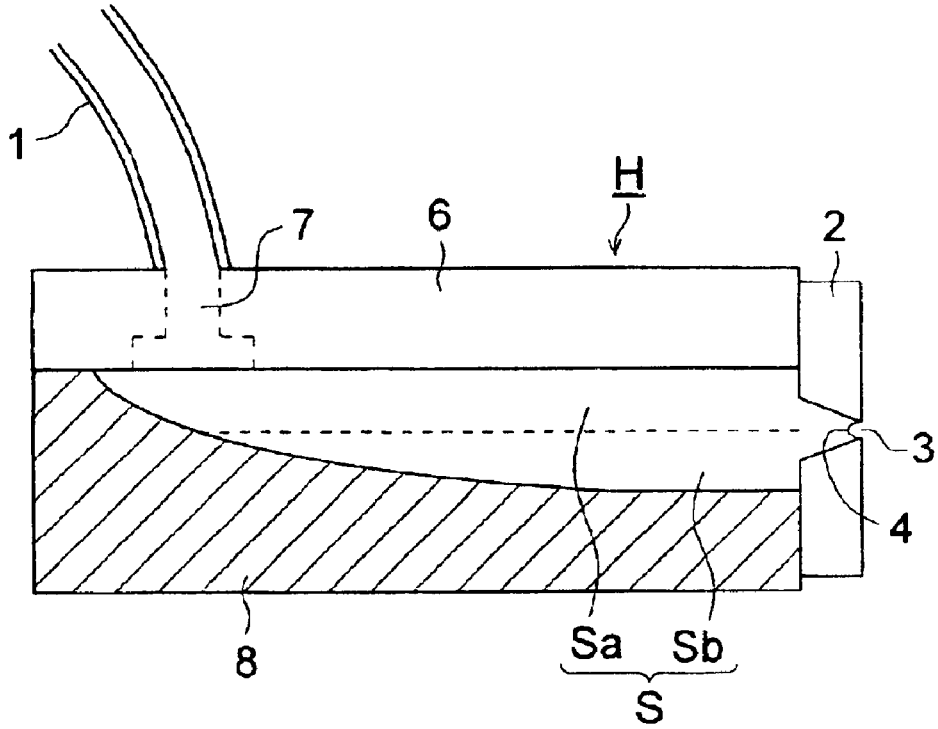
FIG. 4 shows a cross-sectional view of an ink particle emitting device.
Figure 5:
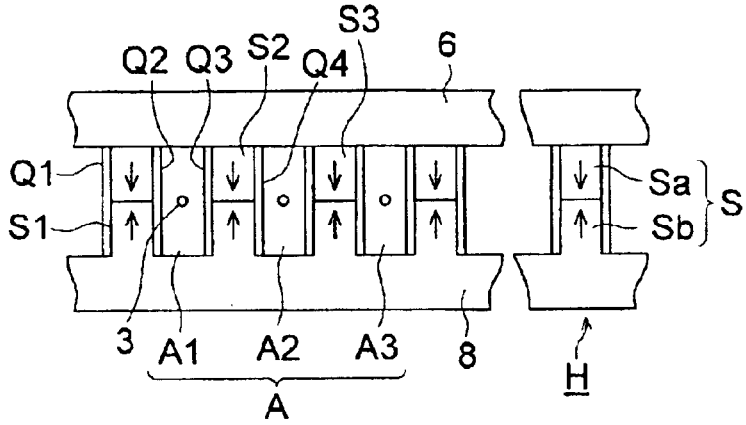
FIG. 5(*a*), FIG. 5(*b*) and FIG. 5(*c*) show cross-sectional views of the ink particle emitting device, illustrating the structure of the sidewall and its motion.
Figure 5:
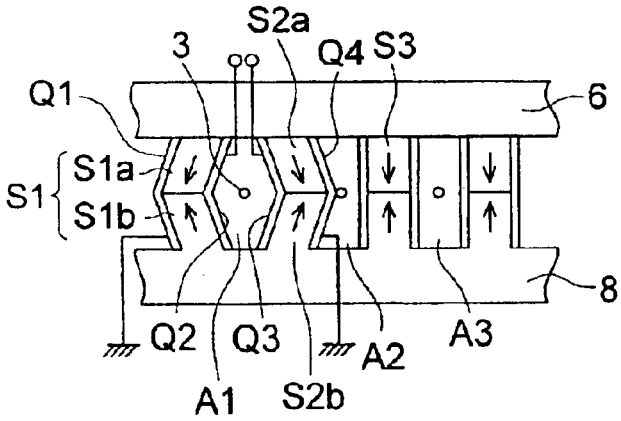
Figure 5:
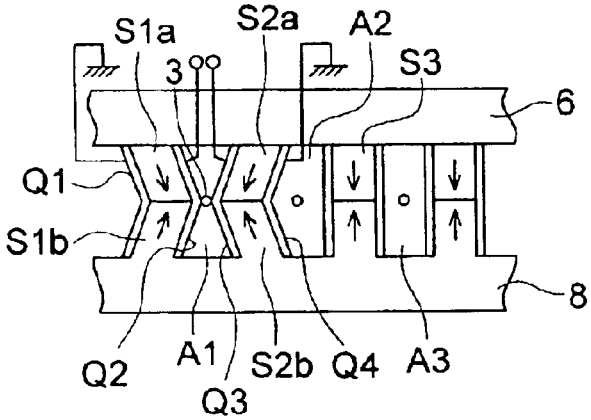

The ink particle emitting device used in the present invention has the mechanical construction as shown in FIG. 4 and FIGS. 5(*a*) to 5(*c*). It is a shear-mode ink particle emitting device. In FIG. 4, 1 denotes an ink tube, 2 denotes nozzle piece, 3 denotes a nozzle, 4 denotes an ink meniscus to be formed by the ink, S denotes the side wall that functions as an electromechanical converting means, 6 denotes a cover plate, 7 denotes an ink supply port, and 8 denotes a board. As shown in FIGS. 5(*a*) to 5(*c*), the ink channel A is constructed by the side wall S, cover plate 6 and board 8. Although the nozzles 3 are provided on each ink channel, some are not shown in FIGS. 5(*a*) to 5(*c*).

Figure 10:
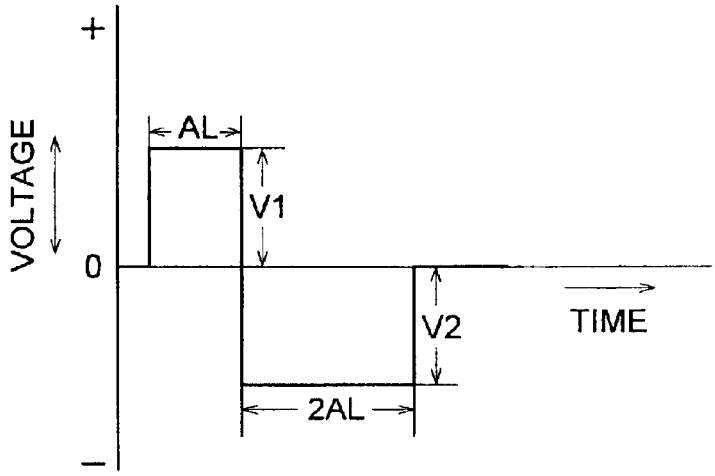
FIG. 10 shows a diagram indicating an example of the waveform of the drive pulse.

Although FIG. 4 shows a cross-sectional view of an ink channel equipped with a nozzle, an actual shear-mode ink particle emitting device H is equipped with a number of ink channels A1, A2, . . . An, separated by multiple side wall S1, S2, . . . , Sn+1, between the cover plate 6 and board 8. One end of the ink channel A1 continues to the nozzle 3 formed on the nozzle piece 2 and the other end continues to the ink supply port 7 and is connected to the ink tank, not shown, by the ink tube 1. On the tip of the nozzle, the ink meniscus 4 is formed by the ink. On the side wall S1, for example, electrodes Q1 and Q2 are attached closely, and on the side wall S2, electrodes Q3 and Q4 are attached closely. In a similar manner, on each side wall of the ink channels A2, . . . An, electrodes are attached closely on both sides. For example, as shown in FIG. 5(*b*), the electrode Q1 is connected to the ground and a drive pulse, comprising a positive first pulse having the wave height V1 (absolute value) and a negative second pulse having the wave height V2 (absolute value) as shown in FIG. 10, is applied to the electrode Q2 from a drive circuit, not shown. Because of this drive pulse, an ink particle is emitted from the nozzles 3 as a result of the operation described hereunder.

Each of the side walls S, S1, S2, . . . is made of two piezoelectric materials of different polarization directions as shown by the arrows in FIGS. 5(*a*), 5(*b*) and 5(*c*), forming the side walls Sa, S1*a*, S2*a*, . . . and Sb, S1*b*, S2*b*, . . . , respectively, and it works as an actuator that deforms as a drive pulse is applied. The side walls S1 and S2 do not deform as shown in FIG. 5(*a*) while no drive pulse is applied on the electrodes Q2 and Q3, but when a drive pulse of the above-mentioned waveform is applied to the electrodes Q2 and Q3, a magnetic field perpendicular to the polarization direction of the piezoelectric material is generated by the voltage +V of the first pulse. Consequently, a shear deformation is generated in the bonded surface of the side wall on both side walls S1*a* and S1*b* and, for the same reason, a shear deformation in the opposite direction is generated also on the side walls S2*a* and S2*b*. Thus, as shown in FIG. 5(*b*), the side walls S1*a* and S1*b* and the side walls S2*a* and S2*b* deform opposite to each other towards the outside and the volume of the ink channel A1 becomes greater in this example. Next, because of the voltage −V of the second pulse of the drive pulse, the side walls S1*a* and S1*b* and the side walls S2*a* and S2*b* deform opposite to each other as shown in FIG. 5(*c*), and the volume of the ink channel A1 decreases very quickly and the inner pressure of the ink channel A1 changes. With the aid of this operation, the ink meniscus 4 formed inside the nozzle by part of the ink in the ink channel A1 is changed and an ink particle is emitted from the nozzle 3. Each ink channel is operated similarly by applying a drive pulse, and an ink particle is emitted.

However, when the sides walls S1 and S2 of the ink channels A1 are operated to deform as above, the adjacent ink channel A2 is affected by the operation. In a normal procedure, because of this, the ink channels A1, A4, A7, . . . , for example, are driven by a pulse of the same phase and then the ink channels A2, A5, A8, . . . are driven in the next cycle. In other words, to generate an image, three ink channels are operated as one unit and the ink channel in each unit is driven sequentially.

The above is a method of emitting an ink particle utilizing the acoustical resonance (hereinafter called the resonance) of the ink channel, where a drive pulse that first increases and then decreases the ink channel volume is applied in adaptation to the resonance period of the ink channel and an ink particle is emitted with the combined aid of the first pulse and the second pulse. According to a prior art, in the drive pulse shown in FIG. 7, both the absolute value of the voltage +V1 of the first pulse in adaptation to the resonance period of the ink channel and that of the voltage −V1 of the second pulse to follow are equally |V|, and the pulse width of the first pulse is half the resonance period, to be explained later, that is, AL. The pulse width of the second pulse is 2AL. A driving method like the above has been employed because driving the ink channel as above enables to emit the ink particles efficiently.

Figure 6:
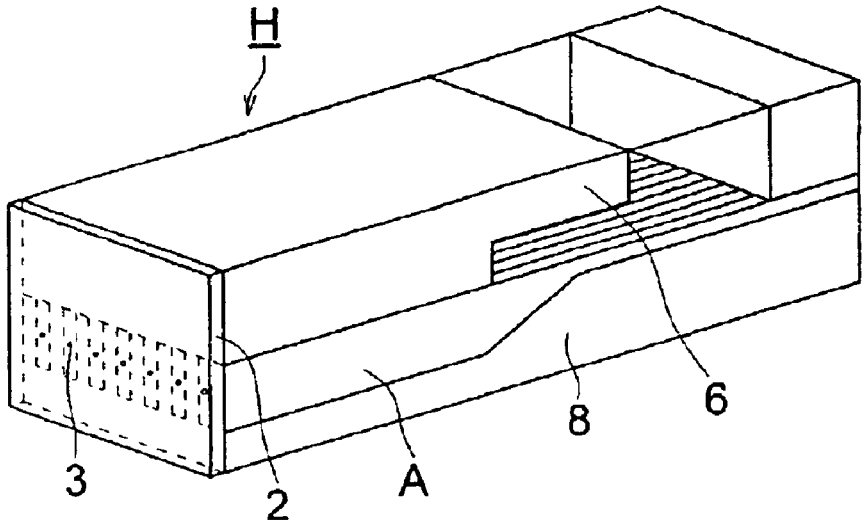
FIG. 6(*a*) and FIG. 6(*b*) show typical views of another example of an ink particle emitting device.
Figure 6:
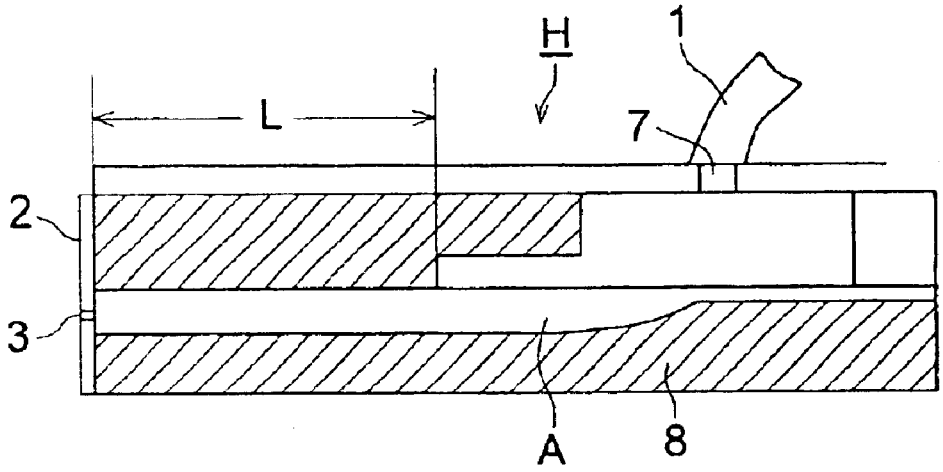

Embodiment of the present invention is not limited to those shown in FIGS. 4 and 5(*a*) to 5(*c*), but various mechanical constructions are possible. Another embodiment of the ink emitting device according to the present invention is shown in FIGS. 6(*a*) to 9(*d*). In FIGS. 6(*a*) to 8(*b*), the same components as in FIG. 4 are denoted the same.

L in FIGS. 6(*a*) and 6(*b*) is the length of the ink channel A, and AL, a half the acoustical resonance period of the ink channel A is expressed by AL≈L/AC. AC is the velocity of the pressure wave inside the ink channel. It must be noted that the length of the ink channel A does not exactly equal to the geometric length L shown in FIG. 6(*b*) but that it is an effective length of the ink channel A. The sign ≈ in the expression above contains a nuance like this.

If the velocity of an ink particle, emitted by applying a rectangular wave to the electromechanical converting means of the ink emitting device, is measured, where the voltage of the rectangular wave is kept constant but the pulse width of the rectangular wave is varied, AL, a half the acoustic resonance period of the ink channel A is obtained as the pulse width at which the particle velocity becomes the maximum.

Figure 7:
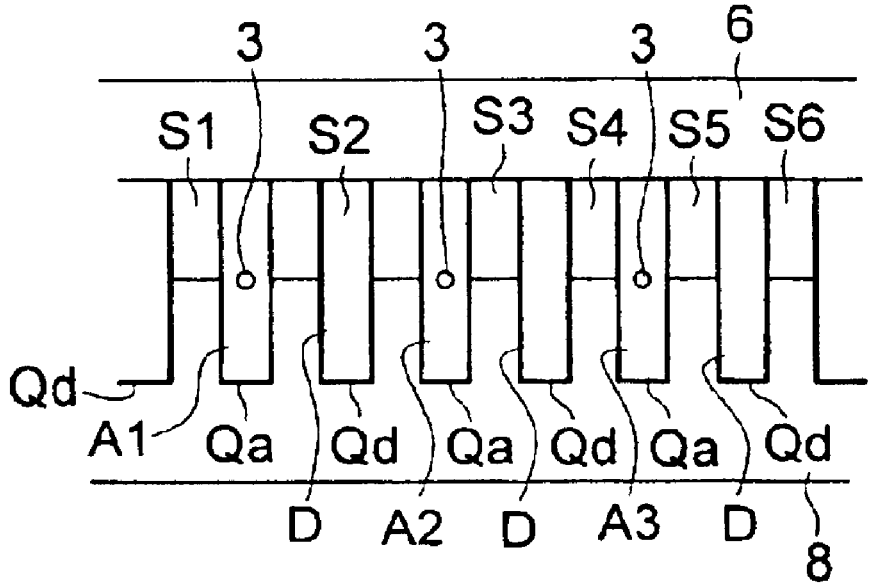
FIG. 7(*a*) and FIG. 7(*b*) show diagrams indicating motions of another ink particle emitting device.
Figure 7:
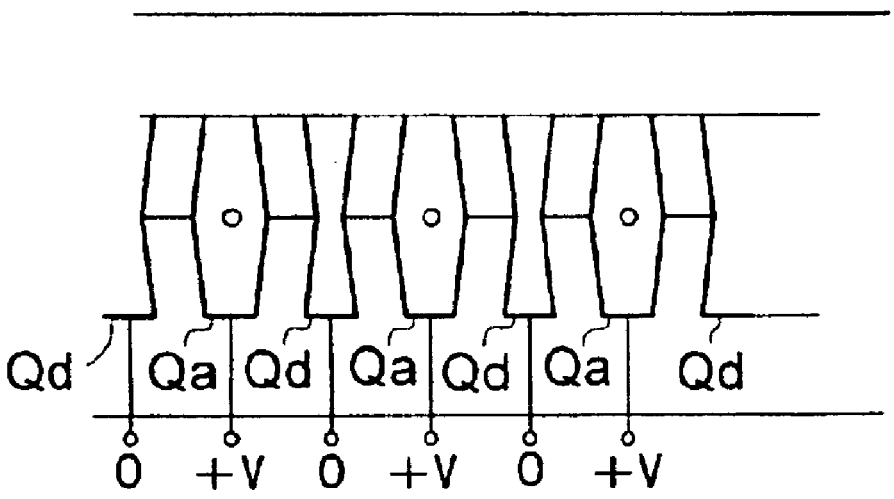

FIGS. 7(*a*) and 7(*b*) show the arrangement of the ink channels of the ink particle emitting device in FIGS. 6(*a*) and 6(*b*) and the motion of each ink channel at the time when a drive pulse is applied.

The ink channels A1, A2, A3, . . . are formed so as to sandwich the air channel D that is formed as space. Electrodes Qa are provided on the side walls forming the ink channels A1, A2, A3, . . . and electrodes Qd are provided on the side walls forming the air channel D. In an example shown in each FIGS. 7(*a*) and 8(*a*), each pulse P1 and P2 is applied to the electrodes Qa from a drive circuit, not shown.

To start with, as shown in FIG. 7(*b*), the pulse P1 with positive voltage +V for increasing the volume of the ink channels A1, A2, A3, . . . is applied to the electrode Qa. Then, as shown in FIG. 8(*a*), the pulse P2 with negative voltage −V for decreasing the volume of the ink channels A1, A2, A3, . . . is applied to the electrode Qa.

A drive pulse comprising the pulse P1 and pulse P2 is applied to the electrode Qa as above, the ink particles fly out of the ink channels A1, A2, A3, . . .

FIGS. 9(*a*) and 9(*b*) show the voltage of the electrodes Qa and Qd in the driving operation of the ink channels A1, A2, A3, . . . As understood from FIGS. 9(*a*) and 9(*b*), a positive pulse P1 and a negative pulse P2 are applied to the electrode Qa in this driving operation.

There is another method of driving the ink channels available as explained below.

FIGS. 9(*c*) and 9(*d*) shows the voltage of the electrodes Qa and Qd in another driving operation. In this driving operation, as shown in FIGS. 9(*c*) and 9(*d*), a pulse P1 with positive voltage is applied to the electrode Qa and a pulse P2 with positive voltage is also applied to the electrode Qd from a drive circuit, not shown.

While increasing the volume of the ink channels A1, A2, A3, . . . is performed in a similar manner as in FIGS. 8(*b*) and 9(*a*), a positive voltage +V is applied to the electrode Qd of the air channel in the driving operation for decreasing the volume of the ink channels A1, A2, A3, . . . With this, a similar driving operation as in FIG. 8(*a*) where a negative voltage is applied to the electrode Qa is available.

A driving method shown in FIGS. 8(*b*), 9(*c*) and 9(*d*) is advantageous in view of circuit design because a positive voltage pulse can be used for driving.

FIG. 10 shows the waveform of the drive pulse that drives the side walls S1, S2, . . . , which functions as an electro mechanical converting means for converting a drive pulse to mechanical displacement, so as to emit the ink in the present invention. As explained before, the drive pulse in FIG. 10 comprises the first pulse with the voltage +V1 for driving the side wall S to increase the volume of the ink channel A and the second pulse with the voltage −V2 for driving the side wall S to decrease the volume of the ink channel A. In the following description on the preferred embodiment, each ink channel A1, A2, . . . is simply called ink channel A except when the description relates to individual ink channel A1, A2, . . . In a similar manner, components of the ink channel such as each side wall S1, S2, . . . is simply denoted as side wall S, without a numbered suffix.

The ratio (V1/V2) of the absolute value V1 of the voltage of the first pulse over the absolute value V2 of the voltage of the second pulse is 1.0 to 5.0. If V1/V2 exceed this range, it is likely to happen that no ink particle is emitted or that a satellite becomes greater and consequently the image quality decreases.

In the present invention, the ink emission per particle is preferably 2 to 20 pl. A range of 2 to 10 pl is more preferable and that of 4 to 7 pl is further more preferable. If the emission exceeds 20 pl, very fine printing becomes difficult and, if it is less than 2 pl, the density of an image to be generated becomes lower.

In the present invention, the size of the dot to be generated on a recording medium is preferably 50 to 200 μm. A range of 50 to 150 μm is more preferable and that of 55 to 100 μm is further more preferable. If the size is less than 50 μm, the density of an image to be generated becomes lower and, if it exceeds 200 μm, very fine printing becomes difficult.

Controlling the dot size to achieve a very fine image is difficult only by controlling the amount of ink particles. The dot size control as in the present invention become possible and hence very fine printing becomes possible by adjusting not only the amount of ink particles but also the ink viscosity, ultraviolet light intensity and irradiation timing.

In the present invention, it is preferable that the ink does not practically contain water and organic solvent. Not practically containing water and organic solvent means the water and organic solvent content is less than 1 weight %. Organic solvent applicable to the present invention includes high-boiling-point low-volatility polyatomic alcohol, such as glycerin, ethylene glycol, diethylene glycol, triethylene glycol, propylene glycol, dipropylene glycol, hexylene glycol, polyethylene glycol, and polypropylene glycol. Also applicable are the monoether compound, diether compound and ester compound thereof, such as ethylene glycol monomethyl ether, ethylene glycol monoethyl ether, ethylene glycol monobutyl ether, diethylene glycol monomethyl ether, diethylene glycol monoethyl ether, and diethylene glycol monobutyl ether. Besides, cellosorb group such as methyl cellosorb and ethyl cellosorb, carbitol group such as methyl carbitol and ethyl carbitol, morpholine group such as morpholine, N-ethyl morpholine, and pyrolidone group such as N-methyl-2-pyrolidone are also applicable. Further, high-volatility monoatomic alcohol such as ethanol, propanol, isopropanol, and butanol are also applicable. Furthermore, ethyl acetate, butyl acetate, methyl benzoate, methyl ethyl ketone, methyl isobutyl ketone, cyclohexanone, N-methyl-2-pyrolidone, N,N dimethyl formaldehyde, ethylene glycol ether group, ethylene glycol acetate group, propylene glycol ether group, and propylene glycol acetate group are also applicable.

An ultraviolet light source used in the present invention can be mercury lamp, metal halide lamp, exymer lamp, UV laser, and LED.

A basic irradiation method is disclosed in the Japanese Application Patent Laid-Open Publication No. Sho 60-132767. According to the publication, a light source is installed on both sides of the head unit and the head and light source are scanned by a shuttle method. The light is irradiated in a certain length of interval after the ink is impacted. Besides, hardening the ink is completed by another light source that is not moved. There is disclosed in WO 9954415 a method utilizing optical fiber and a method where a collimated light source is directed to a mirror surface installed on the side of the head unit and UV light is irradiated on a recorded area. In the recording method according to the present invention, any of these irradiation methods is applicable.

To be concrete, a strip-shaped metal halide lamp bulb or ultraviolet lamp bulb is preferable. It is possible to construct the device at lower cost if the light source is practically fixed on a recording device and moving parts are eliminated.

It is preferable that irradiation is performed at each printing of each color. In other words, it is a preferred embodiment that two light sources are provided, regardless of whatever exposure method is employed, and hardening is completed by the second light source. This contributes to achieving high wettability of the ink to be impacted next and bonding performance between the present and next inks, and constructing the light source at lower cost.

It is preferable to vary the exposure wavelength or exposure illuminance of the first light source from that of the second light source. The first irradiation energy is set smaller than the second irradiation energy, that is, the first irradiation energy is set to 1 to 20% of total irradiation energy, or more preferably to 1 to 10%, or further more preferably to 1 to 5%. Irradiation at different illuminance helps achieve favorable molecular weight distribution after hardening. In other words, if irradiation at high illuminance is performed at a time, high polymerization ratio is attained but the molecular weight of the polymerized composition is lower and accordingly necessary strength cannot be achieved. For a composition like ink for inkjet printing, where viscosity is extremely low, an irradiation method as above produces remarkable effect.

By using longer wavelength in the first irradiation than in the second irradiation, the surface layer of the impacted ink can be hardened in the first irradiation and hence blurredness can be controlled, and the ink layers close to the recording medium up to which an irradiated light hardly reaches can be hardened in the second irradiation and hence bonding performance can be improved. The wavelength of the second irradiation is preferred to be longer in order to accelerate hardening of the inside of ink.

A characteristic of the recording method according to the present invention is that the above-mentioned ink is employed and the ink is heated to a constant temperature and also that the elapse time from the impact of the ink to the irradiation is set to 0.01 to 0.5 second, or preferably to 0.01 to 0.3 second, or more preferably to 0.01 to 0.15 second. By controlling the elapse time from the impact of the ink to the irradiation extremely shorter, the impacted ink can be prevented from being blurred before it is hardened. Beside, even in case a porous recording medium is used, the ink can be exposed to the irradiation light before it penetrates deep into pores up to which the light cannot reach, and hence residual unreacted monomer can be minimized and smell can be reduced. This means use of the ink according to the present invention produces a remarkable synergy effect. With the recording method as above, sizes of the dots impacted even on various types of recording media of different surface wettability can be kept constant and hence the image quality can be improved. In order to attain an excellent color image, it is preferable to superpose colors in order of the brightness, starting from the lowest. If ink with low brightness is superposed on the top, the irradiation light hardly reaches the lower layers of the ink, and hence hardening sensitivity is apt to deteriorate, residual monomer to increase, smell to be caused, and bonding performance to decrease. Irradiation can be performed in one time after all colors of ink are emitted, but individual irradiation on each color is preferable in view of accelerated hardening.

On a printing unit equipped with multiple heads of different colors, it is preferable to construct the unit so that irradiation light is permeable among the colors. To be concrete, a portion between the heads is made of irradiation permeable member or no member is installed between the heads. In the present invention, a simple construction as above is preferable because irradiation can be performed for each color immediately after the ink is impacted and, in particular, the next color to follow can be prevented from blurredness and also, in two-directional printing, difference between the blurredness in one direction and in the other can be prevented (preventing difference between the colors in one direction and in the other).

In the present invention, it is preferable to heat the above ink to 40 to 150° C., or more preferably to 40 to 100° C., so as to lower the viscosity in view of stable emission of the ink. If the temperature is below 40° C. or above 150° C., ink cannot be emitted smoothly. Because photosetting type ink has generally higher viscosity than water ink, viscosity variation caused by temperature variation is greater. Because the viscosity variation gives a direct and remarkable effect on the particle size and particle emission velocity, resulting in poor image quality, the ink temperature needs to be kept as stable as possible. The control range over the ink temperature shall be set to ±5° C., or preferably to ±2° C., or more preferably to ±1° C. The recording device is equipped with a means for stabilizing the ink temperature, and the portions to be kept at a constant temperature include all tubes and parts from the ink tank (or intermediate tank if provided) to the emission surface of the nozzles.

For the temperature control, it is preferable to install multiple temperature sensors on various points on the tubing and heat control is employed in accordance with the ink flow rate and ambient temperature. Besides, it is preferable that the head unit to be heated is thermally isolated or insulated so as not to be affected by the temperature of the device itself and of the ambient. To reduce the start-up time needed for heating the printer and also to reduce the loss of heat energy, it is preferable to thermally insulate the heating unit from other portions and also to reduce the overall thermal capacity of the unit.

In the present invention, a recording medium with no ink absorptivity means paper or cloth into which water ink can hardly penetrates, metallic or plastic material into which the ink cannot penetrate, including a recording medium such as plate and film made of phenol, melamine, vinyl chloride, acryl, polycarbonate and other resins, or a recording medium with a surface layer (printing layer) made of material with no ink absorptivity. Material with no ink absorptivity means, for example, plastic and metal of various kinds.

The viscosity of the ink used in the present invention is preferably 10 to 500 mPa·s at 30° C., and more preferably 40 to 500 mpa·s. If the viscosity is less than 10 mpa·s, blurredness becomes remarkable and, if it exceeds 500 mPa·s, smoothness of print is lost. The viscosity of the ink is preferably 3 to 30 mPa·s at 60° C., and more preferably 3 to 20 mPa·s. If the viscosity is less than 3 mPa·s, high speed emission results in failure and, if it exceeds 30 mPa·s, emission performance deteriorates.

As the photo-polymerizing compound used in the present invention, radical-polymerizing compound, such as photosetting material using the photo-polymerizing composition as disclosed in the Japanese Application Patent Laid-Open Publication No. Hei 07-159983, the Japanese Published Patent No. Hei 07-31399, Japanese Application Patent Laid-Open Publication No. Hei 08-224982, and No. Hei 10-863, and cationic-polymerizing type photosetting resin are known. Of late, photo-cationic-polymerizing type photosetting resin that is sensitized to have wider wavelength beyond the visible light has been disclosed, for example, in the Japanese Application Patent Laid-Open Publication No. Hei 06-43633 and No. Hei 08-324137.

Radical-polymerizing compound is a compound containing ethylenic unsaturated bond that can be radical-polymerized. It can be any form of a compound, including a chemical form of monomer, oligomer and polymer, if it contains at least one ethylenic unsaturated bond that can be radical-polymerized. It is acceptable to use only one type of radical-polymerizing compound, and also to use two or more types together, at a desired mix ratio, so as to improve a desired characteristic.

Compound containing ethylenic unsaturated bond that can be radical-polymerized includes unsaturated carbonic acid and salt thereof, such as acrylic acid, methacrylic acid, itaconic acid, crotonic acid, isocrotonic acid, and maleic acid, and also ester, urethane, amide, anhydride, acrylonitril, styrene, and various types of other radical-polymerizing compounds, such as unsaturated polyester, unsaturated polyether, unsaturated polyamide, and unsaturated urethane. To be specific, they are acrylic derivative such as 2-ether hexyl acrylate, 2-hydroxy ether acrylate, butoxy ether acrylate, carbitol acrylate, cyclohexyl acrylate, tetrahydro furfuryl acrylate, benzyl acrylate, bis (4-acryloxy polyethoxy phenyl)propane, neopentyl glycol acrylate, 1,6 hexanediol diacrylate, ethylene glycol diacrylate, diethylene glycol diacrylate, triethylene glycol diacrylate, tetraethylene glycol diacrylate, polyethylene glycol diacrylate, polypropylene glycol diacrylate, pentaerythritol triacrylate, pentaerythritol tetraacrylate, dipentaerythritol tetraacrylate, trimethylol propane triacrylate, tetramethylol methane tetraacrylate, oligoester acrylate, N-methylol acryl amide, diacetone acryl amide, epoxy acrylate, methacrylic derivative such as methyl methacrylate, n-butyl methacrylate, 2-ethyl hexyl methacrylate, lauryl methacrylate, allyl methacrylate, glycidyl methacrylate, benzyl methacrylate, dimethyl amino methyl methacrylate, 1,6 hexane diol dimethacrylate, ethylene glycol dimethacrylate, triethylene glycol dimethacrylate, polyethylene glycol dimethacrylate, polypropylene glycol dimethacrylate, trimethylol ethane trimethacrylate, trimethylol propane trimethacrylate, 2,2-bis (4-methacryloxy polyethoxy phenyl) propane, and other allylic compound derivative such as acryl glycidyl ether, diallyl phthalate, triallyl trimellitate. To be more concrete, any radical-polymerizing or bridgeable monomer, oligomer and polymer, available in the commercial market or well-known in the industry, can be employed, including those described in "Cross Linking Agent Handbook" by Shinzo Yamashita (Taiseisha, 1981), "UV, EB Hardening Handbook: Material" by Kiyomi Kato (Kobunshi Kanko-Kai, 1985), "Application and Market of UV, EB Hardening Technology", page 79, by Radtech Laboratory (CMA, 1989), and "Polyester Resin Handbook" by Eiichiro Takiyama (Japan Daily Industrial News, 1988). The amount of the above radical-polymerizing compound is preferably 1 to 97 weight %, and more preferably 30 to 95 weight %.

The initiator for radical polymerization include the triazine derivative as disclosed in the Japanese Published Patent (JPP) No. Sho 59-1281, No. Sho 61-621 and Japanese Application Patent Laid-Open Publication No. Sho 60-60104, organic peroxide as disclosed in the Japanese Application Patent Laid-Open Publication No. Sho 59-1504 and No. Sho 61-243807, diazonium compound as disclosed in the JPP No. Sho 43-23684, No. Sho 44-6413, No. Sho 44-6413, No. Sho 47-1604 and U.S. Pat. No. 3,567,453, organic azide compound as disclosed in the U.S. Pat. No. 2,848,328, No. 2,852,379, and No. 2,940,853, orthoquinone diazide as disclosed in the JPP No. Sho 36-22062, No. Sho 37-13109, No. Sho 38-18015, and No. Sho 45-9610, various types of onium compounds as disclosed in the JPP No. Sho 55-39162, Japanese Application Patent Laid-Open Publication No. Sho 59-14023, "Macromolecules" Volume 10, page 1307 (1977), azo compound as disclosed in the Japanese Application Patent Laid-Open Publication No. Sho 59-142205, metallic allene derivative as disclosed in the Japanese Application Patent Laid-Open Publication No. Hei 01-54440, European Patent No. 109,851, No. 126,712, "Journal of Imaging Science" Volume 30, page 174 (1986), (oxo) sulfonium organic boron derivative as disclosed in the Japanese Application Patent (JAP) No. Hei 04-56831 and No. Hei 04-89535, titanocen group as disclosed in the Japanese Application Patent Laid-Open Publication No. Sho 61-151197, transition metal derivative containing the transition metal such as ruthenium as disclosed in the "Coordination Chemistry Review" Volume 84, pages 85 to 277 (1988) and the Japanese Application Patent Laid-Open Publication No. Hei 02-182701, 2,4,5-triallyl imidazol dimer as disclosed in the Japanese Application Patent Laid-Open Publication No. Hei 03-209477, carbon tetrabromide, and organic halogen compound as disclosed in the Japanese Application Patent Laid-Open Publication No. Sho 59-107344. It is preferable that the polymerization initiator as above is contained by a range of 0.01 to 10 weight % in 100 weight % of the compound containing ethylene unsaturated bond that can be radical-polymerized.

Cation polymerization type photosetting resin is a type (mainly an epoxy type) in which macro molecular action is caused by the cation polymerization, such as an epoxy type UV-setting prepolymer or monomer, including prepolymer that contains two or more epoxy bases in a molecule. This type of prepolymer includes alicyclic polyepoxide group, polyglycidyl ester group of polybasic acid, polyglycidyl ether group of polyatomic alcohol, polyglycidyl ether group of polyoxyal quillane glycol, polyglycidyl ether group of aromatic polyol, hydrogen added compound of polyglycidyl ether group of aromatic polyol, urethane polyepoxy compound, and epoxidated polybutadiene group. It is acceptable to use only one type of one of the above prepolymer, and also to use two or more types together in mixture.

Cation-polymerizing compound contained in cation-polymerizing composition includes, for example, (1) styrene derivative, (2) vinyl naphthalene derivative, (3) vinyl ether group, and (4) N-vinyl compound as listed below.

(1) Styrene Derivative

For example, styrene, p-methyl styrene, p-methoxy styrene, β-methyl styrene, p-methyl-β-methyl styrene, α-methyl styrene, and p-methoxy-β-methyl styrene (2) Vinyl Naphthalene Derivative For example, 1-vinyl naphthalene, α-methyl-1-vinyl naphthalene, β-methyl-1-vinyl naphthalene, 4-methyl-1-vinyl naphthalene, and 4-methoxy-1-vinyl naphthalene, (3) Vinyl Ether Group For example, isobutyl vinyl ether, ethyl vinyl ether, phenyl vinyl ether, p-methyl phenyl vinyl ether, p-methyl phenyl vinyl ether, p-methoxy phenyl vinyl ether, α-methyl phenyl vinyl ether, β-methyl isobutyl vinyl ether, and β-chloro isobutyl vinyl ether, (4) N-vinyl Compound For example, N-vinyl carbazole, N-vinyl pyrolidone, N-vinyl indole, N-vinyl pyrrole, N-vinyl phenothiazine, N-vinyl acetoanilide, N-vinyl ethyl acetoamide, N-vinyl succinimide, N-vinyl phthalimide, N-vinyl caprolactam, and N-vinyl imidazol The content of the above cation-polymerizing compound in a cation-polymerizing composition is preferably 1 to 97 weight %, and more preferably 30 to 95 weight %.

Aromatic onium salt can be used as the initiator of cation-polymerizing photosetting resin. Aromatic onium salt includes salt of Va Group element in the Period Table such as phosphonium salt (for example, hexafluoro phosphate triphenyl phenacil phosphonium), salt of VIa Group element such as sulfonium salt (for example, tetrafluoro borate triphenyl sulfonium, hexafluoro phosphate triphenyl sulfonium, and hexafluoro antimonite triphenyl sulfonium), and salt of VIIa Group element such as iodonium salt (for example, chloride diphenyl iodinium).

Use of the aromatic onium salt as the cation-polymerization initiator in the polymerization of epoxy compound is described in detail in the U.S. Pat. No. 4,058,401, U.S. Pat. No. , 4,069,055, U.S. Pat. No. 4,101,513, and U.S. Pat. No. 4,161,478.

Sulfonium salt, element in VIa Group is a preferable cation-polymerization initiator. Among the elements in the group, hexafluoro antimonite triaryl sulfonium is preferable in view of the ultraviolet light hardening performance and storage stability of composition having ultraviolet light hardening performance. Beside, it is possible to freely use any one of the well-known photo-polymerization initiators as described in "Photo-polymer Handbook" (written by Photo-polymer Meeting Member, issued by Industrial Research Laboratory, 1989) or compounds as disclosed in the Japanese Application Patent Laid-Open Publication No. Sho 64-13142 and No. Hei 02-4804.

The ink used in the present invention can contain additive such as reaction thinner, filler, flow enhancer, thixotropic agent, wetting agent, anti-foaming agent, and plasticizer. Besides, it is acceptable to add stabilizer, such as weather resisting agent, UV absorbing agent, anti-oxidation agent, polymerization inhibitor, and anticorrosion agent, or Si compound, or wax.

The coloring material that can be used in the present invention includes conventionally known water-soluble dye, oil-soluble dye, and pigment. In this invention, pigment is more preferable.

Water-soluble dye includes, for example, C. I. Direct Black-2, -4, -9, -11, -17, -19, -22, -32, -80, -151, -154, -168, -171, and -194, C.I. Direct Blue-1, -2, -6, -8, -22, -34, -70, -71, -76, -78, -86, -112, -142, -165, -199, -200, -201, -202, -203, -207, -218, -236, and -287, C. I. Direct Red-1, -2, -4, -8, -9, -11, -13, -15, -20, -28, -31, -33, -37, -39, -51, -59, -62, -63, -73, -75, -80, -81, -83, -87, -90, -94, -95, -99, -101, -110, and -189, C. I. Direct Yellow-1, -2, -4, -8, -11, -12, -26, -27, -28, -33, -34, -41, -44, -48, -58, -86, -87, -88, -135, -142, and -144, C. I. Food Black-1, and -2, C. I. Acid Black-1, -2, -7, -16, -24, -26, -28, -31, -48, -52, -63, -107, -112, -118, -119, -121, -156, -172, -194, and -208, C. I. Acid Blue-1, -7, -9, -15, -22, -23, -27, -29, -40, -43, -55, -59, -62, -78, -80, -81, -83, -90, -102, -104, -111, -185, -249, and -254, C. I. Acid Red-1, -4, -8, -13, -14, -15, -18, -21, -26, -35, -37, -110, -144, -180, -249, and -257, C. I. Acid Yellow-1, -3, -4, -7, -11, -12, -13, -14, -18, -19, -23, -25, -34, -38, -41, -42, -44, -53, -55, -61, -71, -76, -78, -79, and -122.

Oil-soluble dye includes azo dye, metal complex salt dye, naphthole dye, anthraxquinone dye, indigo dye, carbonium dye, quinoimine dye, cyanine dye, quinoline dye, nitro dye, nitroso dye, benzoquinone dye, naphthoquinone dye, naphthal imide dye, perynon dye, and phthalocyanine dye, but not limited thereto.

None-water-soluble dye and pigment are not limited to any but organic pigment, inorganic pigment, colored polymer particle, non-water-soluble dye, dispersing dye, and oil-soluble dye are included. Black pigment includes carbon black pigment such as furnace black, lamp black, acetylene black, and channel black; for example, Raven 7000, Raven 5750, Raven 5250, Raven 5000 ULTRA II, Raven 3500, Raven 2000, Raven 1500, Raven 1250, Raven 1200, Raven 1190 ULTRA II, Raven 1170, Raven 1255, Raven 1080, and Raven 1060 (all above manufactured by Colombian Carbon Co.), Regal 400R, Regal 1330R, Regal 1660R, Mogul L, Black Pearls L, Monarch 700, Monarch 800, Monarch 880, Monarch 900, Monarch 1000, Monarch 1100, Monarch 1300, and Monarch 1400 (all above manufactured by Cabot Co.), Color Black FW1, Color Black FW2, Color Black FW2V, Color Black 18, Color Black FW200, Color Black S150, Color Black S160, Color Black S170, Printex 35, Pritex U, Printex 140U, Printex 140V, Special Black 6, Special Black 5, Special Black 4A, and Special Black 4 (all above manufactured by Degussa Co.), and No. 25, No. 33, No. 40, No. 47, No. 52, No. 900, No. 2300, MCF-88, MA600, MA7, MA8, and MA100 (all above manufactured by Mitsubishi Chemical, Co.) can be used. Besides, magnetic fine particle, such as magnetite and ferrite, and titanium black can also be used as black pigment.

Cyan pigment includes C. I. Pigment Blue-1, C. I. Pigment Blue-2, C. I. Pigment Blue-3, C. I. Pigment Blue-15, C. I. Pigment Blue-15:1, C. I. Pigment Blue-15:3, C. I. Pigment Blue-15:34, C. I. Pigment Blue-16, C. I. Pigment Blue-22, and C. I. Pigment Blue-60.

Magenta pigment includes C. I. Pigment Red-5, C. I. Pigment Red-7, C. I. Pigment Red-12, C. I. Pigment Red-48, C. I. Pigment Red-48:1, C. I. Pigment Red-57, C. I. Pigment Red-112, C. I. Pigment Red-122, C. I. Pigment Red-123, C. I. Pigment Red-146, C. I. Pigment Red-168, C. I. Pigment Red-184, and C. I. Pigment Red-202.

Yellow pigment includes C. I. Pigment Yellow-1, C. I. Pigment Yellow-2, C. I. Pigment Yellow-3, C. I. Pigment Yellow-12, C. I. Pigment Yellow-13, C. I. Pigment Yellow-14, C. I. Pigment Yellow-16, C. I. Pigment Yellow-17, C. I. Pigment Yellow-73, C. I. Pigment Yellow-74, C. I. Pigment Yellow-75, C. I. Pigment Yellow-83, C. I. Pigment Yellow-93, C. I. Pigment Yellow-95, C. I. Pigment Yellow-97, C. I. Pigment Yellow-98, C. I. Pigment Yellow-114, C. I. Pigment Yellow-128, C. I. Pigment Yellow-129, C. I. Pigment Yellow-151, and C. I. Pigment Yellow-154.

In addition to the black as well as three elementary colors of Cyan, Magenta and Yellow, specific color pigment such as red, green, blue, brown and white, metallic glossy pigment such as gold and silver, colorless extender pigment, and plastic pigment can also be used. Further, any newly composed pigment other than the above can also be used. Furthermore, these pigments may have been surface treated. Surface treatment method includes treatment by coupling agent, such as alcohol, acid, base, and silane compound, graft polymerizing treatment, and plasma treatment. The coloring material used in the present invention is preferred to have smaller content of organic and inorganic impurity. Since, coloring material available in the market has higher content of impurity, it is preferable to use refined product of the material. The coloring material used for the aforementioned solid ink composition in the present invention is in a range of 0.5 to 30 weight % of the ink, and preferably in a range of 1 to 15 weight %.

In the present invention, it is preferable to use dispersed pigment. To disperse the pigment, various types of equipment can be used, including ball mill, sand mill, Atlighter, roll mill, agitator, Henschell mixer, colloid mill, ultrasonic homogenizer, purl mill, wet jet mill, and paint shaker. It is also preferable to use centrifugal separator or filter so as to remove coarse particles from the dispersed pigment. The mean particle size of the dispersed pigment used for the water-soluble pigment ink in the present invention is preferably 10 to 200 nm, and more preferably 50 to 100 nm.

Surface active agent may be added, as needed, to the water-soluble pigment ink used in the present invention. Favorable surface active agent used for the water-soluble pigment ink includes anionic surface active agent such as dialkyl-sulfo succinic acid, alkyl naphthalene sulfonate, and fat acid salt, nonionic surface active agent such as polyoxy-ethylene alkyl ether, polyoxy-ethylene allyl ether, acetylene glycol, and polyoxy-propylene block copolymer, and cationic surface active agent such as alkyl amine salt and Class-4 ammonium salt. Among all, anionic surface active agent and nonionic surface active agent are preferable.

In addition to the above, other materials such as anticorrosion agent, mildew preventing agent, and viscosity conditioning agent can be added, as needed, to the water-soluble pigment ink used in the present invention.

Dispersing agent used for dispersing the pigment includes active agent such as high-class fatty acid salt, alkyl sulfate, alkyl ester sulfate, alkyl sulfonate, sulfosuccinic acid salt, naphtha sulfonate, alkyl phosphate, polyoxy alkylene alkyl ether phosphate, polyoxy alkylene alkyl phenyl ether, polyoxy ethylene polyoxy propylene glycol, glycerin ester, sorbithane ester, polyoxy ethylene fatty acid amide, and amine oxide, or block copolymer, random copolymer and salt thereof, comprising two or more monomers selected from styrene, styrene derivative, vinyl naphthalene derivative, acrylic acid, acrylic acid derivative, maleic acid, maleic acid derivative, itaconic acid, itaconic acid derivative, fumaric acid, and fumaric acid derivative.

To disperse the pigment, various types of equipment can be used, including ball mill, sand mill, Atlighter, roll mill, agitator, Henschell mixer, colloid mill, ultrasonic homogenizer, purl mill, wet jet mill, and paint shaker. It is also preferable to use centrifugal separator or filter so as to remove coarse particles from the dispersed pigment.

pH of the ink used in the present invention is preferably in a range of 4 to 10, and more preferably a range of 5 to 9.

The surface tension of the ink used in the present invention is preferably set in a range of 20 to 60 mN/m, and more preferably in a range of 25 to 50 mN/m, in view of the wettability onto the recording medium and head nozzle piece. If the surface tension of the ink becomes lower than 20 mN/m, the ink is apt to overflow from the nozzle and, if it exceeds to 60 mN/m, longer drying time is required.

Surface active agent may be added to the ink, as needed, to adjust the surface tension. Favorable surface active agent for the ink used in the present invention includes, for example, anionic surface active agent such as dialkyl-sulfo succinic acid, alkyl naphthalene sulfonate, and fat acid salt, nonionic surface active agent such as polyoxy-ethylene alkyl ether, polyoxy-ethylene allyl ether, acetylene glycol, and polyoxy-propylene block copolymer, and cationic surface active agent such as alkyl amine salt and Class-4 ammonium salt. Among all, anionic surface active agent and nonionic surface active agent are preferable.

EMBODIMENT

The present invention is explained hereunder, using examples of embodiments, but the embodiments are not limited thereto.

Embodiment 1

[Preparation of Ink]

(Ink 1)

After the ink composition described below is heated to 150° C., mixed and stirred, the liquid obtained is filtered, while being heated, and then cooled to obtain Ink 1. Ink 1 is a solid ink, containing no photo-polymerizing compound, to be used for comparison.

| | |
|---|---|
| Coloring material: C.I. pigment Blue 15:3 (mean dispersion particle size: 100 nm) | 5 weight % |
| Paraffin wax (manufactured by Nippon Seiro Co., 155) | 45 weight % |
| Behenic acid (manufactured by Wako Pure Chemical Industries Ltd.) | 30 weight % |
| Oleic acid amide (manufactured by Kao Corp., fatty acid Amaide ON) | 20 weight % |

(Ink 2 Type)

The following composition is dispersed to obtain dispersed cyan.

| | |
|---|---|
| C.I. pigment Blue 15:3 | 20 weight % |
| High molecular dispersing agent (manufactured by Zeneca Co., Solsperse Series) | 5 weight % |
| Stearyl acrylate | 75 weight % |

The dispersing condition is adjusted so that the mean particle size of the pigment becomes 100 nm, and then the liquid is filtered, while being heated, to prepare the ink.

And then, after the following ink composition is mixed and stirred, without being heated, the fluid is filtered through a filter having the absolute filtering accuracy of 2 $\mu$m to obtain Ink 2 type.

| | |
|---|---|
| Dispersed cyan pigment (mean dispersion particle size: 100 nm) | 5 weight % |
| Photo-polymerizing compound: | |
| Lauryl acrylate (monofunctional) | 10 weight % |
| Ethylene oxide denaturated trimethylol propane triacrylate (trifunctional) | 10 weight % |

Caprolactam Denaturated Pentaerythritol Hexaacrylate (Hexafunctional)

10 to 40 weight % (amount is adjusted so that the viscosity becomes a value in Table 1)

Tetraethylene Glycol Diacrylate (Bifunctional)

5 to 30 weight % (amount is adjusted so that the viscosity becomes a value in Table 1)

Polymerization Initiator:

| | |
|---|---|
| Irgacure 184 (manufactured by Ciba Geigy Japan Ltd.) | 2.5 weight % |
| Irgacure 907 (manufactured by Ciba Geigy Japan Ltd.) | 2.5 weight % |

(Ink 3 type)

After the following ink composition is mixed and stirred, without being heated, the fluid is filtered through a filter having the absolute filtering accuracy of 2 $\mu$m to obtain Ink 3 type.

| | |
|---|---|
| Dispersed cyan pigment (mean dispersion particle size: 100 nm) | 5 weight % |
| Photo-polymerizing compound: | |
| Lauryl acrylate (monofunctional) | 10 weight % |
| Ethylene oxide denaturated trimethylol propane triacrylate (trifunctional) | 10 weight % |
| AT-600 (manufactured by Kyoeisha Chemical Co.) | 10 to 40 weight % (amount is adjusted so that the viscosity becomes a value in Table 1) |
| Tetraethylene glycol diacrylate (bifunctional) | 5 to 30 weight % (amount is adjusted so that the viscosity becomes a value in Table 1) |
| Polymerization initiator | |
| Irgacure 184 (manufactured by Ciba Geigy Japan Ltd.) | 2.5 weight % |
| Irgacure 907 (manufactured by Ciba Geigy Japan Ltd.) | 2.5 weight % |

(Ink 4 Type)

After the following ink composition is mixed and stirred, without being heated, the fluid is filtered through a filter having the absolute filtering accuracy of 2 $\mu$m to obtain Ink 4 type.

| | |
|---|---|
| Dispersed cyan pigment (mean dispersion particle size: 100 nm) | 5 weight % |
| Photo-polymerizing compound: | |
| 1,6-hexanediol diacrylate | 15 weight % |
| 2-phenoxy ethyl acrylate | 20 weight % |
| Polypropylene glycol diacrylate | 10 to 20 weight % (amount is adjusted so that the viscosity becomes a value in Table 1) |
| Octyl acrylate | 10 to 29 weight % (amount is adjusted so that the viscosity becomes a value in Table 1) |
| Polymerization initiator | |
| Irgacure 184 (manufactured by Ciba Geigy Japan Ltd.) | 5 weight % |
| 2-phenoxy ethanol | 1 weight % |

(Ink 5)

Methyl ethyl ketone is added to Ink 3 type by 10 weight %, and then mixed and stirred to obtain Ink 5

[Evaluation]

(Measurement of Viscosity)

The viscosity of each ink prepared as above is measured at 30° C., using a rotational viscometer (Model EDL manufactured by Tokimec Inc.). Results are shown in Table 1.

(Recording an Image)

Figure 11:
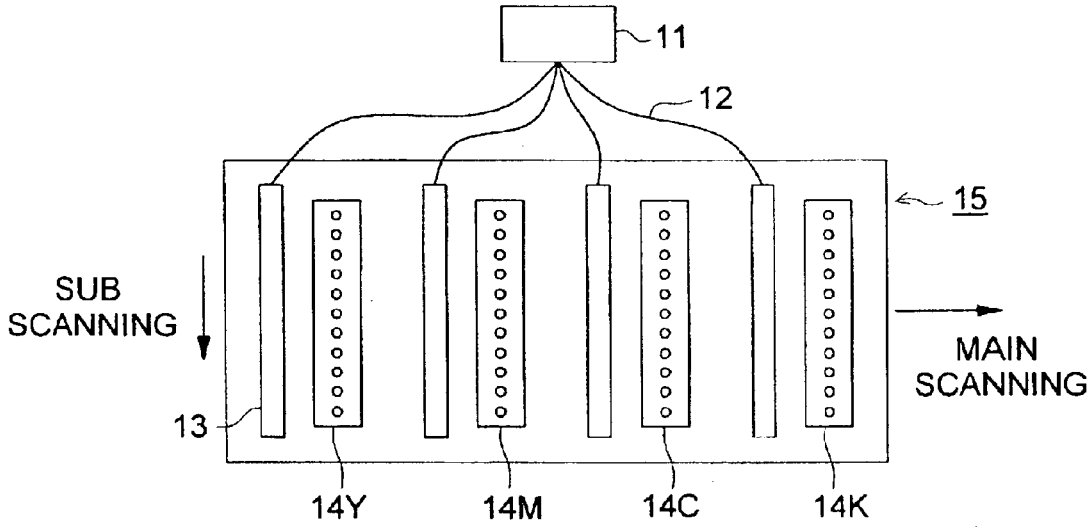
FIG. 11 shows a rough view of the bottom of an example of a print head unit equipped with radiation irradiating portion.
Figure 12:
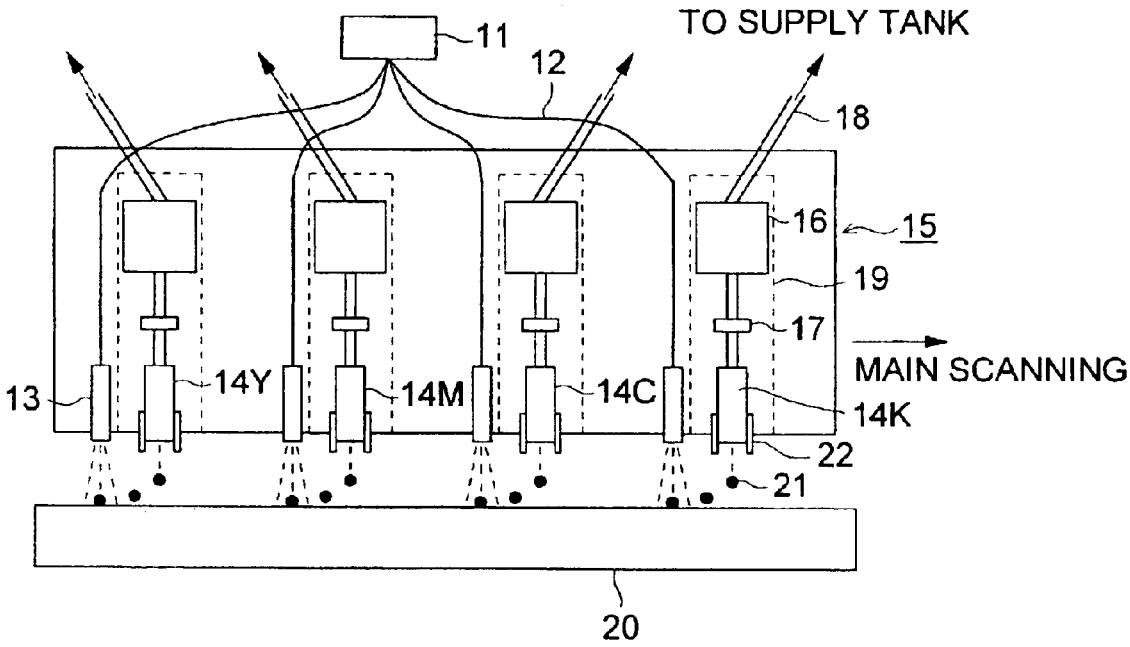
FIG. 12 shows a rough view of the side of an example of a print head unit equipped with a means for adjusting the viscosity by heating.
Figure 13:
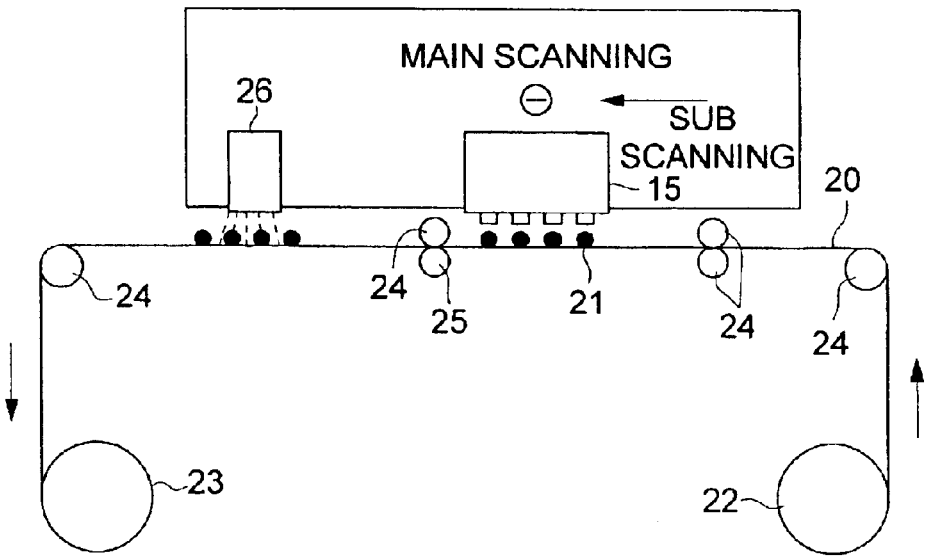
FIG. 13 shows a rough overall view of an example of an inkjet recording unit.

Then, each ink as prepared above is used on a inkjet recording device equipped with piezoelectric inkjet nozzles, constructed as shown in FIG. 11 through FIG. 13, and an image is recorded on a recording medium with no ink absorptivity under an ambient temperature of 25° C.

FIG. 11 shows a brief view of the bottom of an example of a print head unit equipped with radiation irradiating portion that can be used in the present invention.

In FIG. 11, the carriage 15 is equipped with an inkjet head 14Y for Yellow ink, inkjet head 14M for Magenta ink, inkjet head 14C for Cyan ink, and inkjet head 14K for Black ink, and a radiation irradiating portion (UV light irradiating portion) 13, connected to the ultraviolet light source 11 by the optical fiber 12, is provided adjacent to each inkjet head. While the carriage 15 is moved along the main scanning direction, ink is emitted from each inkjet head of different colors 14Y to 14K equipped with multiple nozzles. Immediately after the ink is impacted on the recording medium, ultraviolet light is irradiated from the radiation irradiating portion 13 installed in the downstream so as to harden the impacted ink particles.

FIG. 12 is a brief view of the side of an example of a print head unit, equipped with a means for adjusting the viscosity by heating, that can be used in the present invention.

In FIG. 12, on the carriage 15, there are provided an ink supply tank 16, connected to a source tank (not shown) by a supply tube 18, filter 17, and inkjet units for each color, comprising the ink heads 14Y to 14K, and these components are kept at a specified temperature by a heating unit 19. Besides, each radiation irradiating portion (UV light irradiating portion) 13, connected to the ultraviolet light source 11 by an optical fiber 12, is placed adjacent to the heating unit 19. A pair of shield plates 22 are provided for each inkjet head of different colors 14Y to 14K so that the head is not exposed directly to the ultraviolet light. Similarly as in FIG. 11.

While the carriage 15 is moved along the main scanning direction, the ink particle 21 is emitted from each inkjet head of different colors 14Y to 14K equipped with multiple nozzles that are kept at a constant temperature. Immediately after the ink particle is impacted on the recording medium 20, ultraviolet light is irradiated from each radiation irradiating portion 13 installed in the downstream so as to harden the impacted ink particles 21.

FIG. 13 is a brief overall view of an example of an inkjet recording unit that can be used in the present invention.

In FIG. 13, the recording medium transferred from a supply roll 22 is sent to the printing section via a support roll 24, the ink particle 21 is emitted from each inkjet head inside the carriage 15 that is constructed as shown in FIG. 11 and FIG. 12, and the ink particle is impacted on the recording medium and hardened. And then, after the recording medium 20 is cooled down by a chiller roll 25, ultraviolet light is again irradiated from a post-treatment exposing device 26, provided in the downstream, onto the medium so that unreacted polymerized compound is hardened completely and the hardening process is completed. The recording medium on which the printing and fixing process of an image has completed is then taken up by a take-up roll.

The ink supply system comprises a source tank, supply pipe, ink supply tank located just before the inkjet head, filter, and piezoelectric inkjet head, and an area from the ink supply tank up to the inkjet head are thermally insulated and heated. Temperature sensor is installed each near the ink supply tank and nozzle of the inkjet head so that the temperature of the nozzle portion is controlled to be always kept at a set temperature ±2° C. Set temperature is shown in Table 1. The piezoelectric inkjet head is driven by a drive signal shown in FIG. 12 so that a multi-size dot of 2 to 30 pl can be emitted at a resolution of 720×720 dpi. In this invention, "dpi" means the number of dots per inch, that is, 2.54 cm.

Two different waveforms shown in FIGS. 14(A) and 14(B) are used for the drive pulse for emitting the ink particle. The absolute value of the voltage V1 of the first pulse is adjusted so that the amount of emission per particle becomes a value in Table 1 at the emission speed 5 to 10 m/s of the ink particle.

After the ink is impacted, the illuminance of the exposure surface of the UV-A light is varied in a range of 1 to 100 $mW/cm^2$ and the dot size is adjusted as the illuminance is increased so as to decrease the dot size and the illuminance is decreases so as to increase the dot size. The exposing system, main scanning speed and emission frequency are adjusted so that the irradiation begins after the ink is impacted on the recording medium. The irradiation amount of the UV light is set to 300 $mJ/cm^2$ all the time, which is the energy sufficient to harden the ink completely, so that a touch of adhesion cannot be felt.

(Blurredness)

Printing is performed on 100 sheets of the medium by the method described above, and the printability is visually checked and evaluated in the four grades shown below.

VG: No nozzle fault is seen and the printability if excellent

G: No nozzle fault is seen but the print is slightly in disorder

B: Some nozzle faults are seen and the print is in disorder

VB: Many nozzle faults are seen and the print is in disorder (Clogging)

After printing is performed by the described above, the printer is left as it is for six hours while the head temperature is kept constant. And then, printing is performed again, and clogging is visually checked and evaluated in the four grades shown below.

VG: No clogging is seen and the printability is excellent

G: Slight missing is seen

B: Clogging is seen but the printer can print again with a simple reset operation VB: The printer cannot print again (Abrasion-Resistance of Image)

The solid part of the prints, prepared by the method described above, is subjected to a scratch strength tester HEIDON-18 (manufactured by Heidon Co.) and the result is measured. A sapphire needle of 0.8 mmR is used as the measuring needle, and a scratch test in 10 cm is performed three times, each varying the load to the sapphire needle. A limit load at which scratch does not reach up to the backing of the medium is regarded as the abrasion resistance of image and evaluated in the three grades shown below.

A: 2N or more

B: 1N to 2N, exclusive

C: Less than iN (Image Quality)

8-point letters are printed by the method described above, and the coarseness of letters and shape of the dots are observed using a magnifier, and the result is evaluated in the four grades shown below.

VG: No coarseness is seen and the dot shape is true circular

G: Slight coarseness is seen but the dot shape is true circular

B: Coarseness is seen and the dot shape is slightly in disorder (allowable lowest limit)

VB: Coarseness is seen and the dot shape is very bad (Smoothness)

Ultraviolet light is irradiated on the solid part of the prints, prepared by the method described above, and the ink film thickness is measured and evaluated in the four grades shown below.

VG: Very thin and excellent

G: A bit thicker but does not effect very fine printing

B: Thickness is at the allowable lowest limit

VB: Thickness is at a very bad level not suitable for use

The results of the evaluation is shown in Table 2.

TABLE 1

| Sample | Drive pulse | | Ink | | | | | | |
|---|---|---|---|---|---|---|---|---|---|
| | | | | Viscosity at 30° C. | Pigment particle size | Emission temperature | Emission amount | Dot size | |
| No. | Waveform | V1/V2 | Type | (mPa · s) | (mm) | (° C.) | (pL) | (μm) | Remarks |
| 1 | B | — | 2 type | 45 | — | 60 | 5 | 57 | Comp. |
| 2 | B | — | 3 type | 75 | 100 | 60 | 5 | 57 | Comp. |
| 3 | A | 0.5 | 3 type | 45 | 100 | 60 | 5 | 57 | Comp. |
| 4 | A | 6 | 3 type | 45 | 100 | 60 | 5 | 57 | Comp. |
| 5 | A | 2 | 2 type | 45 | 100 | 60 | 5 | 57 | Inv. |
| 6 | A | 3 | 2 type | 45 | 100 | 60 | 5 | 57 | Inv. |
| 7 | A | 1 | 2 type | 45 | 100 | 60 | 5 | 57 | Inv. |
| 8 | A | 1 | 1 | 35 | 100 | 150 | 5 | 57 | Inv. |
| 9 | A | 1 | 5 | 5 | 100 | 60 | 5 | 57 | Inv. |
| 10 | A | 1 | 4 type | 22 | 100 | 25 | 5 | 57 | Inv. |
| 11 | A | 1 | 3 type | 75 | 100 | 60 | 5 | 57 | Inv. |
| 12 | A | 1 | 3 type | 45 | 100 | 100 | 5 | 57 | Inv. |
| 13 | A | 1 | 2 type | 45 | 100 | 60 | 37 | 57 | Inv. |
| 14 | A | 1 | 2 type | 45 | 100 | 60 | 20 | 57 | Inv. |
| 15 | A | 1 | 2 type | 45 | 100 | 60 | 10 | 115 | Inv. |
| 16 | A | 1 | 2 type | 45 | 100 | 60 | 5 | 46 | Inv. |
| 17 | A | 1 | 2 type | 45 | 100 | 60 | 17 | 205 | Inv. |
| 18 | A | 1 | 2 type | 45 | 100 | 60 | 5 | 90 | Inv. |
| 19 | A | 1 | 2 type | 45 | 100 | 60 | 5 | 57 | Inv. |
| 20 | A | 1 | 3 type | 180 | 100 | 110 | 5 | 57 | Inv. |
| 21 | A | 1 | 3 type | 600 | 100 | 155 | 5 | 57 | Comp. |

Comp.; Comparison example
Inv.; Present invention

TABLE 2

| Sample No. | Blurredness | Clogging | Abrasion resistance of image | Image quality | Smoothness |
|---|---|---|---|---|---|
| 1 | VB | VB | A | B | G |
| 2 | VB | VB | A | B | G |
| 3 | VB | B | A | B | G |
| 4 | VB | B | A | B | G |
| 5 | VG | G | A | G | G |
| 6 | G | G | A | G | G |
| 7 | VG | VG | A | G | G |
| 8 | G | B | VB | G | VB |
| 9 | B | B | A | B | G |
| 10 | B | G | A | B | G |
| 11 | B | G | A | B | G |
| 12 | G | G | A | VG | B |
| 13 | B | G | A | B | B |
| 14 | B | G | A | G | B |
| 15 | G | G | A | B | VG |
| 16 | G | G | A | B | G |
| 17 | B | G | A | B | G |
| 18 | G | G | A | G | G |
| 19 | VG | G | A | VG | G |
| 20 | G | G | A | G | G |
| 21 | No emission | No emission | No emission | No emission | No emission |

With the present invention, it becomes possible to provide an inkjet recording method that is free from clogging in ink head and blurredness of print, achieves excellent stability (abrasion resistance, etc.) of print product, and is capable of very fine printing with controlled dot sizes, and also an inkjet recording method that is capable of printing very fine images stably on every type of printing material.

Disclosed embodiment can be varied by a skilled person without departing from the spirit and scope of the invention.

What is claimed is:

1. A method for recording an image on a recording medium through an ink-jetting process, comprising the steps of:

heating an ink, containing at least photo-polymerizing compound and coloring material, to a temperature in a range of 40–150° C.;

expanding and shrinking a volume of an ink channel, which accommodates said ink and which is driven as electromechanical converting actions, by applying a first electronic pulse for generating a negative pressure in said ink channel and by successively applying a second electronic pulse for generating a positive pressure in it, to emit an ink particle from a nozzle of said ink channel onto said recording medium so as to form said image thereon; and irradiating ultraviolet light onto said recording medium to fix said image thereon;

wherein, at a time after said ink particle is emitted by applying a first driving pulse, being a combination of said first electronic pulse and said second electronic pulse, to said ink channel and before an ink meniscus, formed at said nozzle, grows to an original stable state, a next ink particle is emitted by applying a second driving pulse, being a next combination of said first electronic pulse and said second electronic pulse; and wherein a ratio between absolute voltage values of said first electronic pulse and said second electronic pulse, both included in said second driving pulse, is defined as the equations of $$R=V1/V2 \text{ and } 1.0 \leqq R \leqq 5.0$$

where R: said ratio, V1: an absolute voltage value of said first electronic pulse, V2: an absolute voltage value of said second electronic pulse; and wherein a duration time of said first electronic pulse, included in said second driving pulse, is substantially equal to half an acoustical resonance period of said ink channel, while a duration time of said second electronic pulse, included in said second driving pulse, is substantially equal to twice said acoustical resonance period of said ink channel.

2. The method of claim 1, wherein a plurality of ink channels, each of which is said ink channel, are provided for forming said image, and said electromechanical converting actions are achieved by deforming partitions of said plurality of ink channels in response to said first electronic pulse and said second electronic pulse, and wherein said partitions include piezoelectric elements being deformable in a shearing mode.

3. The method of claim 1, wherein an ink emitting amount per said ink particle is in a range of 2–20 pl (pico liter).

4. The method of claim 1, wherein a diameter of a dot, formed on said recording medium by emitting said ink particle thereon, is in a range of 50–200 $\mu$m.

5. The method of claim 1, wherein water and organic solvent are substantially excluded from components of said ink.

6. The method of claim 1, wherein said recording medium has no ink absorptivity.

7. The method of claim 1, wherein said coloring material includes pigment, a mean dispersion particle-size of which is in a range of 10–200 nm, and an added amount of which is in a range of 0.5 to 30 mass-percent.

8. A method for recording an image on a recording medium through an ink-jetting process, comprising the steps of:

heating an ink, containing at least photo-polymerizing compound and coloring material, to a temperature in a range of 40–150° C.;

expanding and shrinking a volume of an ink channel, which accommodates said ink and which is driven as electromechanical converting actions, by applying a first electronic pulse for generating a negative pressure in said ink channel and by successively applying a second electronic pulse for generating a positive pressure in it, to emit an ink particle from a nozzle of said ink channel onto said recording medium so as to form said image thereon; and irradiating ultraviolet light onto said recording medium to fix said image thereon;

wherein, at a time after said ink particle is emitted by applying a first driving pulse, being a combination of said first electronic pulse and said second electronic pulse, to said ink channel and before an ink meniscus, formed at said nozzle, grows to an original stable state, a next ink particle is emitted by applying a second driving pulse, being a next combination of said first electronic pulse and said second electronic pulse; and wherein a ratio between absolute voltage values of said first electronic pulse and said second electronic pulse, both included in said second driving pulse, is defined as the equations of $$R=V1/V2 \text{ and } 1.0 \leqq R \leqq 5.0$$

where R: said ratio, V1: an absolute voltage value of said first electronic pulse, V2: an absolute voltage value of said second electronic pulse; and wherein a viscosity of said ink is in a range of 10–500 mPa·s at a temperature of 30° C.

9. An apparatus for recording an image on a recording medium through an ink-jetting process, comprising:

an ink-heating section to heat an ink, containing at least photo-polymerizing compound and coloring material, to a temperature in a range of 40–150° C.;

an ink-jetting head having an ink channel, which accommodates said ink and includes electromechanical converting elements, a volume of said ink channel being expanded and shrunken by applying a first electronic pulse to said electromechanical converting elements for generating a negative pressure in said ink channel and by successively applying a second electronic pulse to them for generating a positive pressure in it, to emit an ink particle from a nozzle of said ink channel onto said recording medium so as to form said image thereon; and an ultraviolet light irradiating section to irradiate ultraviolet light onto said recording medium for fixing said image thereon;

wherein, at a time after said ink particle is emitted by applying a first driving pulse, being a combination of said first electronic pulse and said second electronic pulse, to said ink channel and before an ink meniscus, formed at said nozzle, grows to an original stable state, a next ink particle is emitted by applying a second driving pulse, being a next combination of said first electronic pulse and said second electronic pulse; and wherein a ratio between absolute voltage values of said first electronic pulse and said second electronic pulse, both included in said second driving pulse, is defined as the equations of $$R=V1/V2 \text{ and } 1.0 \leqq R \leqq 5.0$$

where R: said ratio, V1: an absolute voltage value of said first electronic pulse, V2: an absolute voltage value of said second electronic pulse; and wherein a duration time of said first electronic pulse, included in said second driving pulse, is substantially equal to half an acoustical resonance period of said ink channel, while a duration time of said second electronic pulse, included in said second driving pulse, is substantially equal to twice said acoustical resonance period of said ink channel.

10. The apparatus of claim 9, wherein said ink-jetting head has a plurality of ink channels, each of which is said ink channel, and emits ink particles by deforming partitions of said plurality of ink channels in response to said first electronic pulse and said second electronic pulse, and wherein said partitions include piezoelectric elements serving as said electromechanical converting elements and being deformable in a shearing mode.

11. The apparatus of claim 9, wherein an ink emitting amount per said ink particle is in a range of 2–20 pl (pico liter).

12. The apparatus of claim 9, wherein a diameter of a dot, formed on said recording medium by emitting said ink particle thereon, is in a range of 50–200 $\mu$m.

13. The apparatus of claim 9, wherein water and organic solvent are substantially excluded from components of said ink.

14. The apparatus of claim 9, wherein said recording medium has no ink absorptivity.

15. The apparatus of claim 9, wherein said coloring material includes pigment, a mean dispersion particle-size of which is in a range of 10–200 nm, and an added amount of which is in a range of 0.5 to 30 mass-percent.

16. An apparatus for recording an image on a recording medium through an ink-jetting process, comprising:

an ink-heating section to heat an ink, containing at least photo-polymerizing compound and coloring material, to a temperature in a range of 40–150° C.;

an ink-jetting head having an ink channel, which accommodates said ink and includes electromechanical converting elements, a volume of said ink channel being expanded and shrunken by applying a first electronic pulse to said electromechanical converting elements for generating a negative pressure in said ink channel and by successively applying a second electronic pulse to them for generating a positive pressure in it, to emit an ink particle from a nozzle of said ink channel onto said recording medium so as to form said image thereon; and an ultraviolet light irradiating section to irradiate ultraviolet light onto said recording medium for fixing said image thereon;

wherein, at a time after said ink particle is emitted by applying a first driving pulse, being a combination of said first electronic pulse and said second electronic pulse, to said ink channel and before an ink meniscus, formed at said nozzle, grows to an original stable state, a next ink particle is emitted by applying a second driving pulse, being a next combination of said first electronic pulse and said second electronic pulse; and wherein a ratio between absolute voltage values of said first electronic pulse and said second electronic pulse, both included in said second driving pulse, is defined as the equations of $$R=V1/V2 \text{ and } 1.0 \leqq R \leqq 5.0$$

where R: said ratio, V1: an absolute voltage value of said first electronic pulse, V2: an absolute voltage value of said second electronic pulse; and wherein a viscosity of said ink is in a range of 10–500 mPa·s at a temperature of 30° C.

* * * * *